United States Patent [19]

Nix

[11] 4,313,779

[45] Feb. 2, 1982

[54] ALL ELECTRIC FRICTION FUSION STRAPPING TOOL

[75] Inventor: Robert J. Nix, Park Ridge, Ill.

[73] Assignee: Signode Corporation, Glenview, Ill.

[21] Appl. No.: 153,782

[22] Filed: Jun. 4, 1980

Related U.S. Application Data

[63] Continuation-in-part of Ser. No. 61,900, Jul. 30, 1979, abandoned.

[51] Int. Cl.[3] ..... B32B 31/00

[52] U.S. Cl. ..... 156/361; 100/33 PB; 156/73.5; 156/515; 156/580

[58] Field of Search ..... 156/515, 580, 73.5, 156/361, 378, 494, 350; 100/33 PB

[56] References Cited

U.S. PATENT DOCUMENTS

| | | | |
|---|---|---|---|
| 2,982,069 | 5/1961 | England | 100/331 PB |
| 3,368,323 | 2/1968 | Wood | 156/580 X |
| 3,397,105 | 8/1968 | Takami | 156/494 |
| 3,442,203 | 5/1969 | Kobiella | 100/33 PB X |
| 3,442,732 | 5/1969 | Stensaker | 100/33 PB |
| 3,442,733 | 5/1969 | Vileins | 100/33 PB X |
| 3,442,734 | 5/1969 | Ericsson | 100/33 PB X |
| 3,442,735 | 5/1969 | Stensaker | 100/33 PB X |
| 3,554,845 | 1/1971 | Billett et al. | 156/580 |
| 3,554,846 | 1/1971 | Billett et al. | 156/73.5 X |
| 3,586,572 | 6/1971 | Ericsson | 156/380 X |
| 3,586,590 | 6/1971 | Brenneisen | 156/580 |
| 3,709,758 | 1/1973 | Gilmore | 156/494 |
| 3,799,835 | 3/1974 | Gilmore | 156/580 |

*Primary Examiner*—David A. Simmons

*Attorney, Agent, or Firm*—Dressler, Goldsmith, Shore, Sutker & Milnamow, Ltd.

[57] ABSTRACT

A tool is provided for constricting a loop of thermoplastic strap that encircles an article and has overlapping strap segments and for sealing the segments with a friction fusion weld. A multiple drive shaft assembly is driven by a motor which can be rotated in a first direction and then in a second, opposite direction. The drive shaft assembly is engaged to a tension wheel in the first direction of rotation to constrict and tension the loop. A sensing and control means senses a predetermined loop tension level and reverses rotation of one of the drive shafts to the second direction. A mechanism responsive to the rotation of the shaft in the second direction is provided for pressing the overlapping strap segments together and for moving one of the segments relative to the other segment to effect the friction fusion weld.

35 Claims, 15 Drawing Figures

186
3.
188
194
200
198
190
180
455
502
500
196
450
504
132
100
124
166
168
108
70
92
126
106
112
114
122
120
U
L
30
3.

ALL ELECTRIC FRICTION FUSION STRAPPING TOOL

CROSS-REFERENCE TO RELATED APPLICATION

This is a continuation-in-part application of the copending U.S. patent application Ser. No. 061,900, filed July 30, 1979 now abandoned.

DESCRIPTION

1. Technical Field

This invention relates to automatically operated, self-contained strapping tools for constricting and tensioning a loop of thermoplastic strap about a package or other article and for then sealing the overlapping segments of the strap loop with a friction fusion weld.

2. Background of the Invention

Prior art strapping devices are commonly disclosed as being powered by pneumatic or electric motors. A number of strapping tools have been developed which join the ends of a thermoplastic strap about a package with a friction fusion weld. See U.S. Pat. Nos. 3,442,732 to Stensaker et al. 3,442,733 to Vilcins; 3,442,735 to Stensaker; 3,554,845 to Billett et al.; 3,586,572 to Ericsson; 3,709,758 to Gilmore; and 4,001,064 to Nix. Additionally, tools have been developed for welding two sheets of plastic together by friction. An example of such a tool is disclosed in U.S. Pat. No. 3,586,590 to Brenneisen.

Some of the prior art tools, while functioning well in the limited applications for which they are intended, do not have the capability for applying high tension to a strap loop. Therefore, it would be desirable to provide a tool in which relatively high tension (e.g., 350 pounds force) could be applied to the strap loop around the package.

Despite the fact that some of the inventions disclosed in the above-listed patents are embodied in commercial products, there still remains a need for a tool that can tension a thermoplastic strap loop to a high tension level, seal the overlapping strap segments with a friction fusion weld, and still be relatively small, relatively light weight, and relatively easy to operate and handle when strapping articles of various sizes and shapes.

It would be desirable to provide a tool in which the essential tensioning and sealing functions are provided by operation of a single electric motor. Further, it would be beneficial if such a tool were provided with a mechanism for severing the trailing portion of the strap before or as the overlapping strap loop segments are being welded.

It would also be advantageous to provide a tool wherein the welding of the overlapping strap segments can be effected in an untensioned region of one of the overlapping strap segments. Further, in this respect, it would be desirable to provide a tool in which one of the overlapping strap segments can be oscillated, in a direction transverse to the strap length, relative to the other, fixed strap segment.

Some prior art tools effect a friction fusion weld of overlapping strap segments by moving at least one of the segments in a longitudinal direction relative to the strap length. In those tools in which the overlapping strap segments are held together after tensioning by mechanisms "upstream" of the welding area, certain problems must be overcome in effecting a longitudinal weld.

For example, in order to oscillate one or both of the straps in the longitudinal direction, the tension in the strap must be overcome for the slight oscillation movement away from the point where both straps are firmly gripped upstream of the weld area. Thus, the drive system for the oscillating mechanism must be strong enough to stretch the strap a bit during the oscillation of the strap away from the gripping point. Although the problem could be solved by sliding one or both of the straps in the weld region towards the gripping point to create a flexibility "hump" in the strap or straps, this can lead to the formation of a loose loop.

Regardless of the exact process by which a longitudinal friction fusion weld is made in overlapping strap segments, the longitudinal weld requires, by definition, longitudinal movement of one or both of the overlapping strap segments. This longitudinal movement creates a small "hump" during each oscillation when the strap or straps are moved upstream toward the gripping point. Repeated flexing of the strap during the rapid oscillations can cause a fatigue fracture or can otherwise weaken the strap segments or segment in the region where the hump is repeatedly formed.

A transverse weld, in contrast, does not create a hump in either of the overlapping strap segments and thus does not contribute to a loosening of the strap loop or to a weakening of the strap.

SUMMARY OF THE INVENTION

The tool of the present invention is relatively light weight and compact, so that the tool can be readily manipulated and used for extended periods of time without tiring the user. In its preferred embodiment, the tool is electrically operated to constrict and tension a loop of thermoplastic strap that encircles an article and that has overlapping strap segments. The tool also automatically continues to effect a friction fusion weld of the overlapping strap segments and to sever the trailing portion of the strap from the strap loop.

To effect these operations, the tool incorporates a single, reversible electric motor which is connected to a first drive shaft defining a receiving bore with a longitudinal axis concentric with the longitudinal axis of the first drive shaft. The motor is adapted for rotating the first shaft sequentially in a first direction and then in a second, opposite direction. A second shaft is mounted with one end of the second shaft received in the receiving bore of the first shaft. The other end of the second shaft is connected, through a suitable gear transmission, to a rotatable feed wheel which engages one of the overlapping strap loop segments and is adapted to pull the overlapping strap segment to constrict and tension the loop when the motor is operated in the first direction of rotation.

A one way clutch mechanism is provided within the first shaft receiving bore for engaging the first and second shafts to permit rotation of the second shaft with the first shaft in the first direction to tension the strap loop and to permit the first shaft to rotate in the second, opposite direction without effecting a rotation of the second shaft in the second direction.

A suitable mechanism is provided for sensing a predetermined level of tension in the constricted strap loop. Appropriate control means are provided and are responsive to the loop tension sensing mechanism for reversing rotation of the motor from the first direction of rotation to the second direction of rotation when the predetermined loop tension level is sensed.

A novel mechanism responsive to the rotation of the first shaft in the second direction is provided for pressing the overlapping strap segments together after the strap loop has been tensioned to the predetermined level. Specifically, a pressing member is actuated by a linkage system and biased against the overlapping strap segments. However, when the motor and shafts are rotating in the first direction to tension the strap loop, the pressing member linkage is latched in a position which maintains the pressing member out of engagement with the overlapping strap segments. A second clutch means and driven release member are provided on the first shaft for rotating in the second direction, but not in the first direction, to release the latch means and allow the pressing member to be biased against the overlapping strap segment after the loop has been tensioned and the motor rotation reversed.

The pressing member is also engaged with an eccentric portion of the first drive shaft in a manner that effects oscillation of the pressing member so that when the pressing member is engaged with the overlapping strap segments, at least one of the segments is moved generally transversely of the strap length relative to the other of the strap segments to effect a friction fusion weld of the overlapping segments.

A saw blade mechanism is provided for cutting the trailing portion of the strap loop before or as the weld is being made. In one embodiment, a saw blade is horizontally disposed between the overlapping strap segments with the saw blade teeth pointing upwardly against the upper strap segment. When the upper strap segment is pressed against the lower strap segment and oscillated to effect a friction fusion weld, the upper strap segment moves against the saw blade teeth and is severed thereby.

In another embodiment, the saw blade is mounted above both overlapping strap segments and is biased downwardly by a spring to cut the upper overlapping strap segment during the friction fusion welding process. During those periods of tool operation when the pressing member is maintained in the elevated position out of engagement with the upper strap segment, the saw blade is held up by the pressing member so that the saw blade does not contact the strap.

The novel combination of elements in accordance with the present invention yields desirable and beneficial results which are not only new and different, but which also provide a substantial improvement over the prior art.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DETAILED DESCRIPTION OF THE PREFERRED EMBODIMENTS

Figure 1:
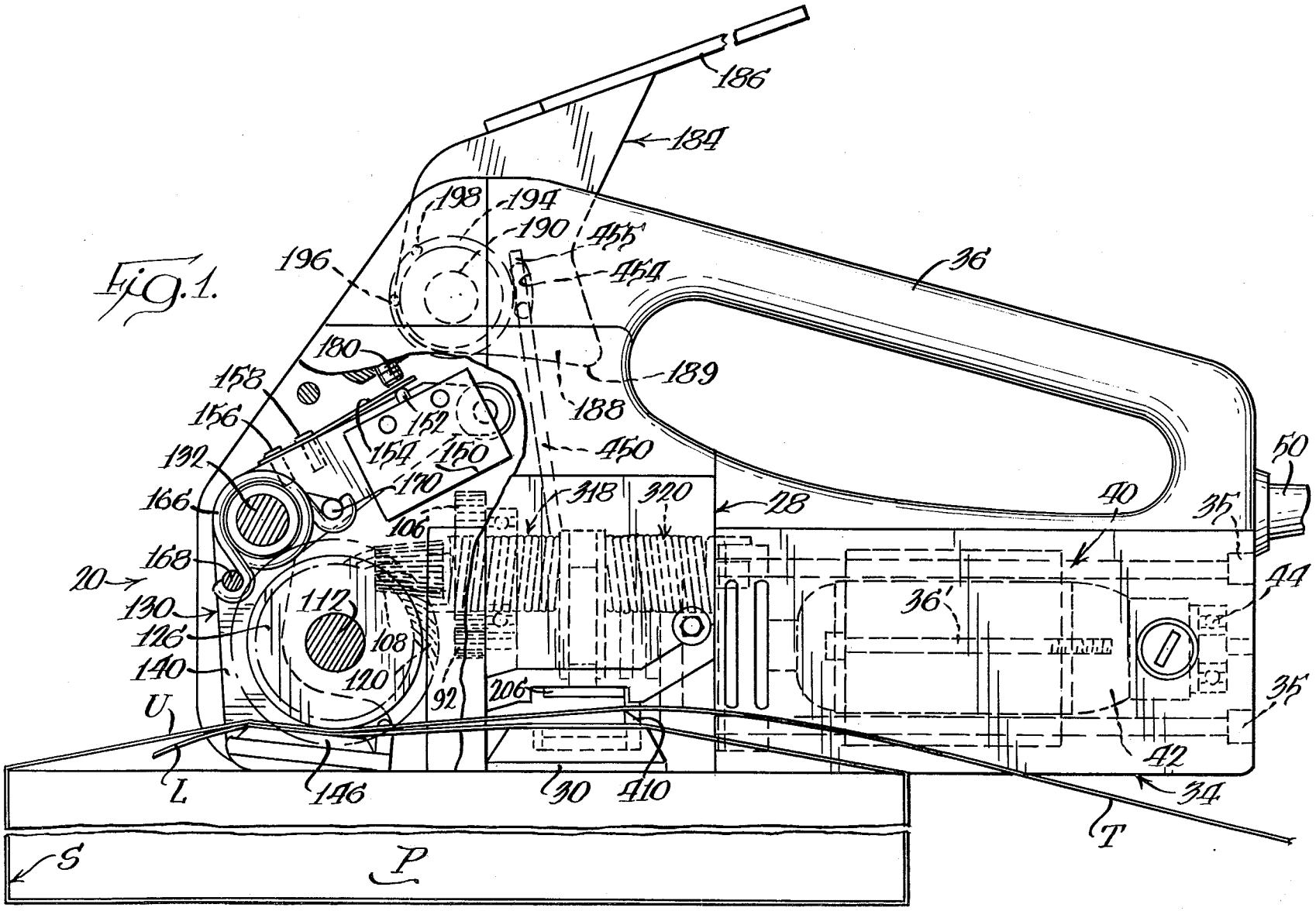
FIG. 1 is a side elevational view of the tool of the present invention, with the tool being illustrated upon an article in a tension drawing position and with portions of the structure broken away in sections to facilitate disclosure.

While this invention is susceptible of embodiment in many different forms, there are shown in the drawings and will herein be described in detail specific embodiments, with the understanding that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with reference to a particular embodiment.

For ease of description, the apparatus of this invention will be described in a normal operating position and terms such as upper, lower, horizontal, etc., will be used with reference to this normal operating position. It will be understood, however, that the apparatus of this invention may be manufactured, stored, transported and sold in an orientation other than the normal operating position described.

The apparatus of this invention has certain conventional drive mechanisms and control mechanisms the details of which, though not fully illustrated or described, will be apparent to those having skill in the art and an understanding of the necessary functions of such mechanisms.

Referring now to the drawings in detail, the tool of the present invention is illustrated generally at 20 in FIG. 1 and is shown seated upon a package P which is represented with a loop of strap S encircling it and having a first or upper overlapping segment U and a second or lower overlapping strap segment L threaded through the tool. The upper or first overlapping strap segment U may lead from a suitable supply reel not shown. As the upper strap segment U extends beyond the second or lower overlapping strap segment L, it can be said to comprise a standing or trailing portion T of the strap S.

The main framing structure of the tool 20 consists of a sealer housing 28 with a base 30, a gear box 32 (FIG. 2), a motor enclosure 34 bolted to the sealer housing 28 with bolts 35, a handle assembly 36, and associated supporting and connecting pieces. The framing structure and housing may comprise a number of pieces, wall sections, and plates which fit together and are joined by suitable means, such as with bolts and/or screws. Preferably the frame and housing pieces are adapted to be easily removed to allow access to particular interior regions of the tool 20 for the purposes of routine inspection and/or periodic maintenance of the mechanisms within those regions.

In operation, the tool 20 is applied to an already formed strap loop by inserting the overlapping segments U and L of the strap loop into the tool 20 as illustrated in FIG. 1. Subsequently, the tool 20 is activated to automatically constrict and tension the strap loop tight around the package P to a predetermined tension level whereupon the tool 20 subsequently and automatically serves the trailing portion T of the strap S from the loop and joins the overlapping strap segments U and L with a friction fusion weld.

The tool 20 will be described in detail with reference to the following listed mechanisms and in the order listed:

(1) The motor and multiple shaft assembly for providing power to the tool;

(2) The transmission and the tension wheel;

(3) The tension sensing mechanism;

(4) The means for oscillating one of the overlapping strap segments relative to the other for forming the friction fusion weld;

(5) The means for holding the overlapping straps together during the welding sequence;

(6) The strap severing mechanism; and (7) The tool reset mechanism.

Motor and Drive Shaft Assembly

Figure 8:
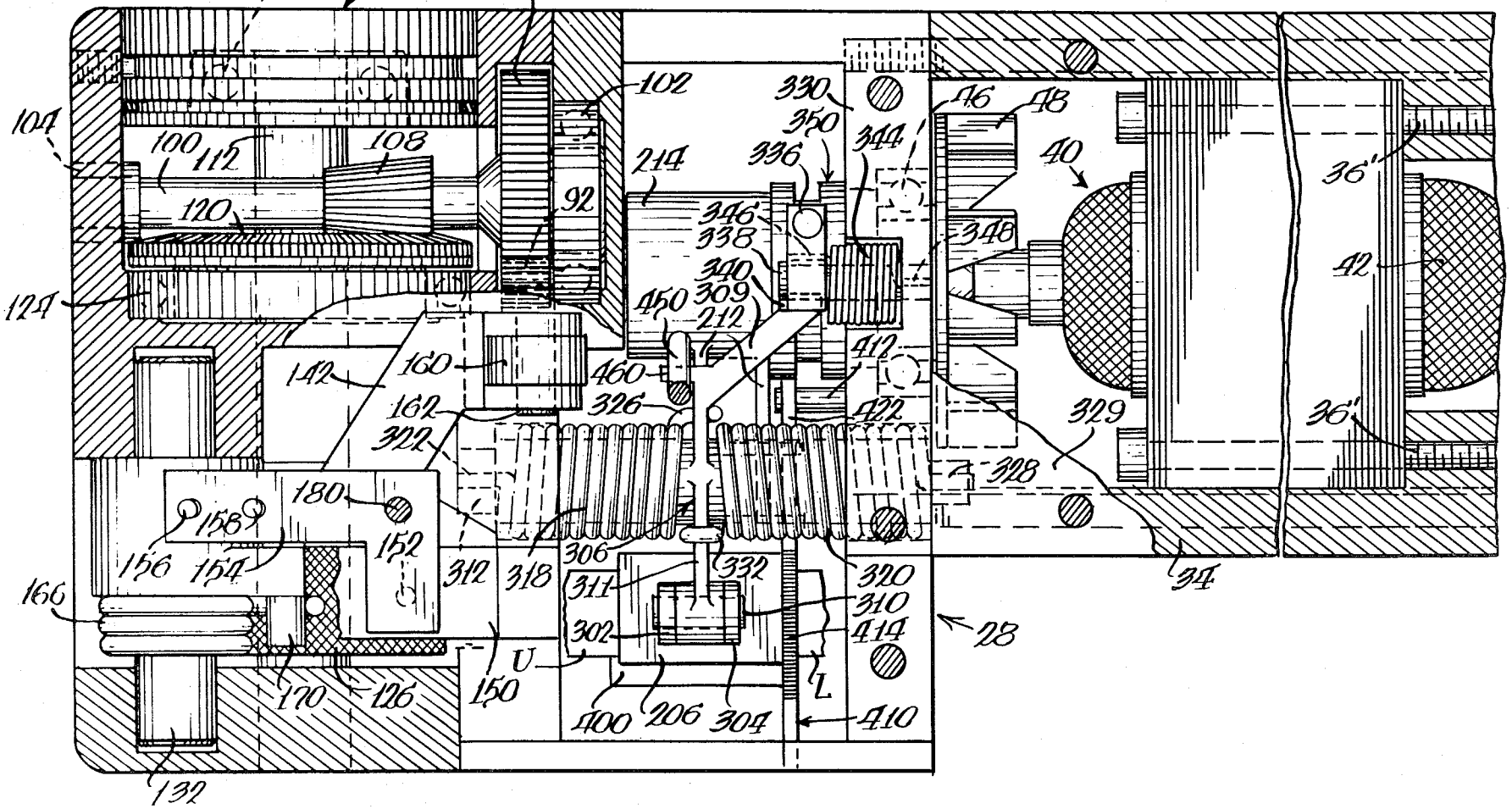
FIG. 8 is a fragmentary cross-sectional view taken generally along the various planes 8—8 in FIG. 4.

The novel motor and shaft assembly will be described with reference now to FIGS. 1, 2, 8 and 9. A reversible, electric motor 40 is mounted within the motor housing 34 by suitable bolts 36' (FIG. 8). The motor 40 has a rotating armature and shaft assembly 42 supported at one end in bearing 44 (FIG. 1) in the motor housing 34 and at the other end in bearing 46 (FIG. 8) which is mounted in a wall portion 330 of the sealer housing 28. A cooling fan 48 is mounted on the armature shaft 42 just inwardly of bearing 46. Power to the motor is introduced through the motor housing 34 by means of the electric cord 50 (FIG. 1).

Figure 9:
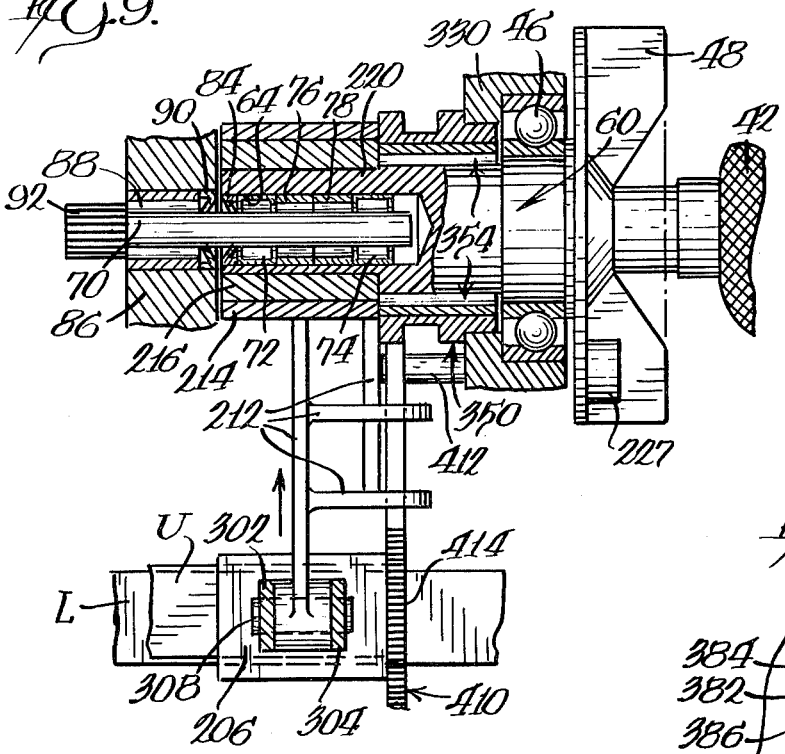
FIG. 9 is a fragmentary, cross-sectional view taken generally along the plane 9—9 in FIG. 7.

With reference now to FIG. 9, the motor armature and shaft assembly 42 is seen to include first drive shaft means or first drive shaft 60 which rotates about the longitudinal axis of the armature shaft 42 and which defines a receiving bore 64 at one end.

A second shaft 70 is mounted at one end within the receiving bore 64 of the first shaft 60 and is mounted for rotation relative to the first shaft 60 by means of suitable needle bearings 72 and 74. Forward of the needle bearing 72 (to the left of needle bearing 72 as viewed in FIG. 9) a rubber grease seal 84 may be employed to protect the bearing.

A pair of one way clutches 76 and 78 are disposed within the two needle bearings 72 and 74 in the annular region defined between the first shaft 60 and the second shaft 70. The driving portion of each clutch 76 and 78 is secured to the first shaft 60 for rotation therewith. During strap loop tensioning the one way clutch mechanisms 76 and 78 permit the first shaft 60 to drive the second shaft 70 in a first direction of rotation. However, the clutches permit the first shaft 60 to rotate in the second, opposite direction during friction fusion welding of the overlapping strap segments without effecting a rotation of the second shaft 70 in that second direction.

Two clutches 76 and 78 are incorporated only for purposes of power transmitting capability. A single clutch of sufficient load transmitting capability could be used.

Any suitable one way clutch mechanism may be employed for the clutches 76 and 78, such as the type that has the form of a plurality of inwardly facing clutch teeth which trap cylindrically shaped rollers therebetween and wherein the teeth are shaped to allow the outer, first shaft 60 to rotate freely in one direction but bind the rollers against the inner, second shaft 70 when the outer, first shaft 60 is rotated in the opposite direction thereby causing both shafts to rotate together. Such a clutch mechanism is of a well-known conventional design and further description or illustration of such a clutch mechanism is unnecessary.

The portion of the second shaft 70 projecting from the first shaft 60 passes through a suitable support wall 86 associated with the housing or frame of the tool. The support wall 86 carries a one way clutch 88, similar to clutches 76 and 78, but oppositely acting from clutches 76 and 78, to positively prevent rotation of shaft 70 relative to support wall 86, and hence relative to first shaft 60, in the second direction of rotation. A grease seal 90 is retained in support wall 86 provided between the first shaft 60 and the clutch 88.

On the distal end of the second shaft 70, and integral therewith, is a drive pinion gear 92. The drive pinion gear 92 is operable, through a transmission means described hereinafter, to operate the mechanism for constricting the strap loop to a predetermined tension level.

Transmission and Tension Wheel

Figure 2:
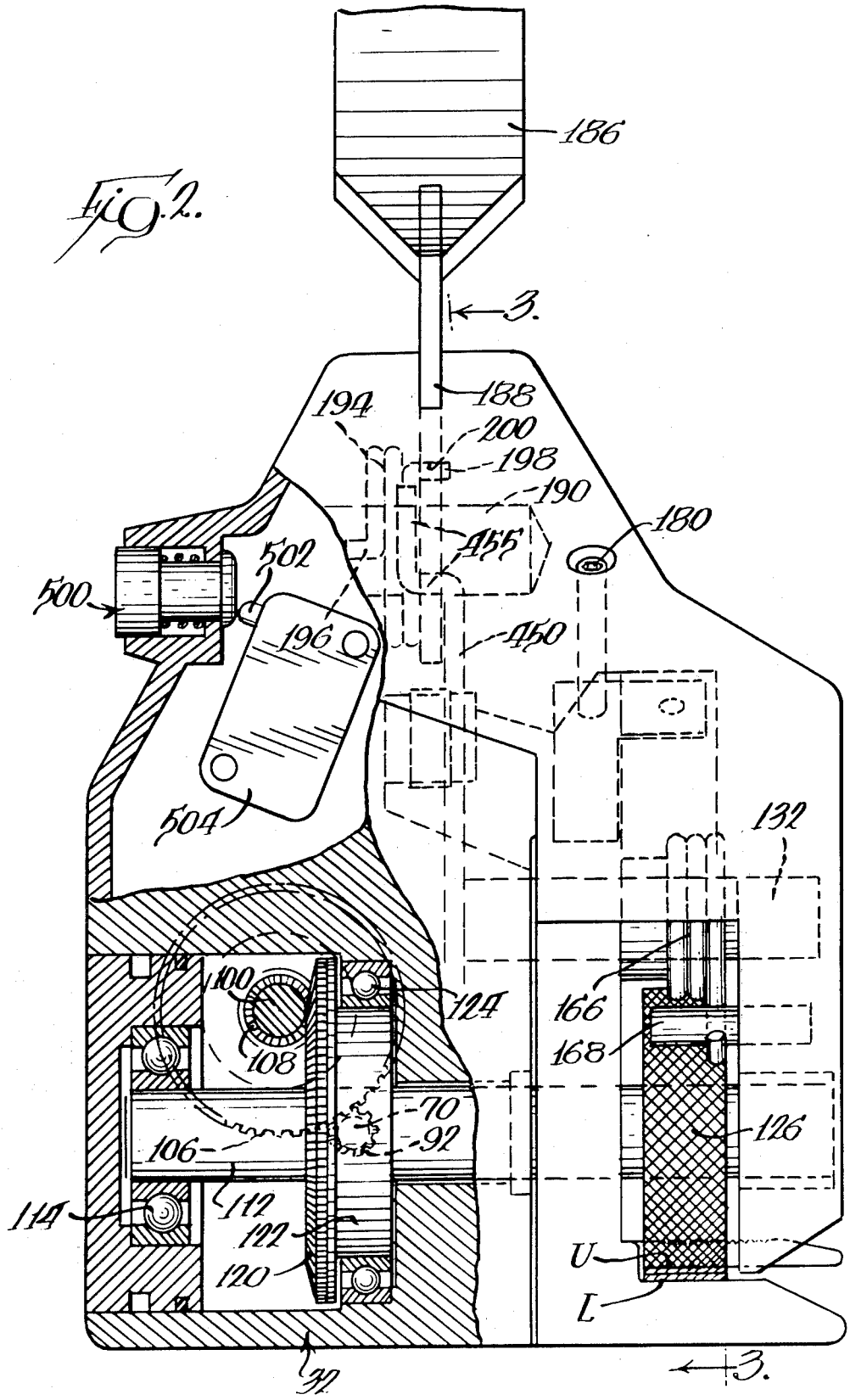
FIG. 2 is a fragmentary front elevational view, partially cut away to show interior details, of the apparatus illustrated in FIG. 1.

With reference now to FIGS. 2 and 8 in particular, the drive pinion gear 92 is seen to project into the gear housing 32 which houses a gear transmission comprising a shaft 100 mounted in gear housing 32 on one end by means of a roller bearing assembly 102 and on the other end of the gear housing 32 by means of a roller bearing assembly 104. A ring gear 106 is fixed to the shaft 100 for rotation therewith and is in engagement with drive pinion gear 92. Also secured to shaft 100 is a spiroid worm gear 108.

Another shaft 112 is mounted generally perpendicular to shaft 100 across the gear housing 32 by means of a ball bearing assembly 114 at one end. A gear 120 is fixed to shaft 112 for rotation therewith and is engaged with the spiroid worm gear 108. The gear 120 has a reduced diameter portion 122 which is mounted within a bearing 124 at one end of the gear housing 32.

The shaft 112 projects from the gear housing 32 (to the right as viewed in FIG. 2) and extends to the exterior of the gear housing 32 where it carries a tension wheel 126 which is keyed to shaft 112 for rotation therewith. With reference to FIGS. 1, 2, 3 and 4, it is to be noted that the tension wheel 126 rotates in a counterclockwise direction during the loop constricting for tensioning step when the motor 40, and consequently first shaft 60 and second shaft 70, are rotated in the first direction (shaft 70 rotating clockwise as viewed in FIG. 2). This pulls the upper overlapping strap segment U to the right, as viewed in FIG. 1, to constrict the loop S and apply tension to the loop.

The above-described transmission and tension wheel mechanism are only one example of a tension means for tensioning the strap. By appropriate design it would be possible to provide other mechanisms for tensioning the strap and which could be included as part of the novel drive shaft assembly.

Tension Sensing Mechanism

A sensing and control means is provided for sensing a predetermined level of tension in the strap loop and for reversing the rotation of the motor to change rotation of the first shaft from the first direction of rotation (during which strap tensioning occurs) to the second direction of rotation (during which the overlapping strap segments are welded by friction fusion). The sensing and control means is also preferably constructed to cooperate with the tension wheel 126 to, in a self-energizing manner, maintain the overlapping strap segments pressed tightly against the tension wheel.

Figure 3:
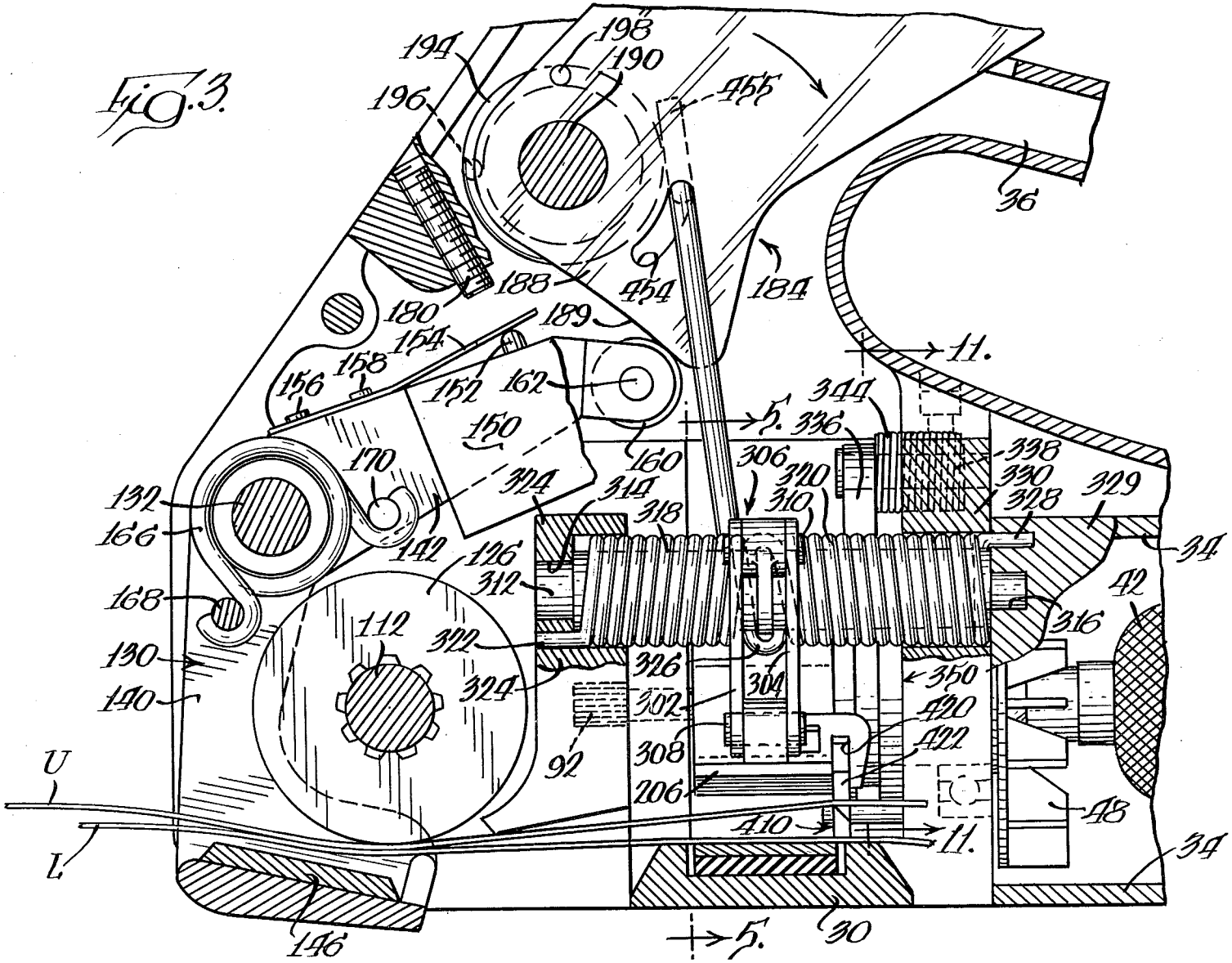
FIG. 3 is an enlarged, fragmentary, cross-sectional view taken generally along the planes 3—3 in FIG. 2 and showing the tool in a strap loading position.
Figure 4:
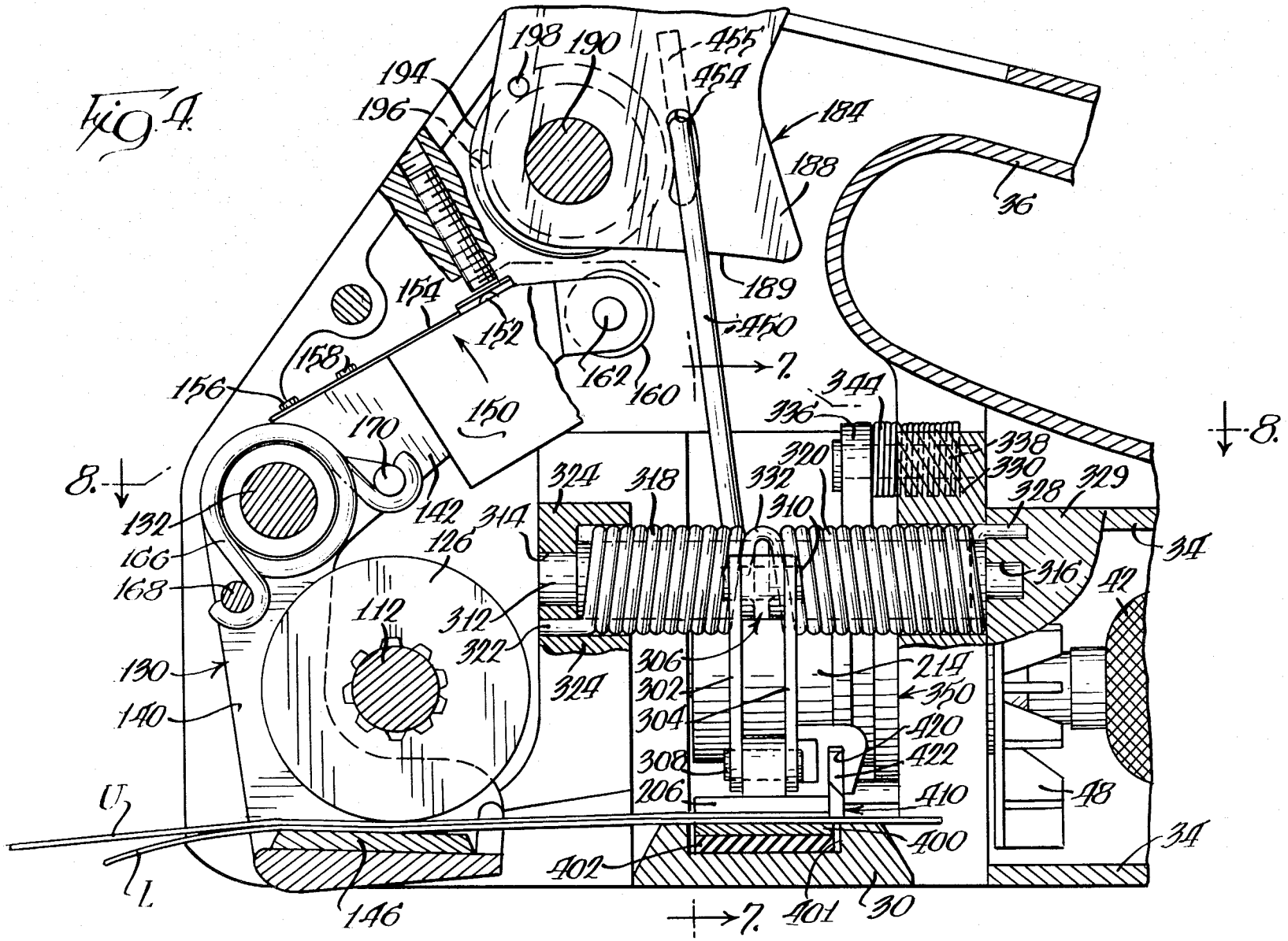
FIG. 4 is a view similar to FIG. 3 but showing the tool in a tensioned and sealing position.

With reference to FIGS. 3, 4 and 8, a tension arm 130 is shown pivotably mounted about a shaft 132, which shaft 132 is mounted at each end in the tool housing. The tensioner arm 130 has a lower arm 140 extending alongside the tension wheel 126 and an upper arm 142 extending above the tension wheel 126. The lower arm 140 of the tension arm 130 carries an anvil 146 which is adapted to contact the lower strap segment L as illustrated in FIG. 4.

The upper arm 142 of the tensioner arm 130 carries a tension sensing limit switch 150 having a contact member 152 projecting upwardly from the arm 142.

The tension sensing switch 150 is part of a control circuit (not illustrated) associated with the electric motor 40 for reversing the rotation of a motor from the first direction (during which the tension wheel 126 is rotated counterclockwise as viewed in FIG. 1 to tension the strap loop) to the second, opposite direction for effecting a friction fusion weld at the overlapping strap segments as will be described in detail hereinafter.

A spring plate 154, having a generally L-shaped configuration as best illustrated in FIG. 8, is mounted to the top of the upper arm 142 and is bent outwardly as best illustrated in FIG. 3 so that the underside of the spring plate 154 just touches the switch contact member 152 but does not urge contact member 152 downwardly to actuate the switch 150. The spring plate 154 is secured to the upper arm 142 by suitable screws 156 and 158.

A roller 160 is mounted at the distal end of the upper arm 142 for rotation about a shaft 162 carried by the upper arm 142.

The tension arm 130 is biased about its mounting shaft 132 in a counterclockwise direction, as viewed in FIG. 3, by a torsion spring 166 which is secured at one end about a lug 168 projecting from the tool housing and at the other end to a lug 170 projecting from the upper arm 142. Under the urging of the spring 166, the tension arm 130 rotates to press the overlapping strap segments U and L against the tension wheel 126 as illustrated in FIG. 1. During the tensioning sequence, the tension wheel 126 rotates in a counterclockwise direction, as viewed in FIG. 1, so that the upper overlapping strap segment U is gripped by the tension wheel 126 and moved or pulled to the right (as viewed in FIG. 1) to constrict the strap loop S and to tension the loop about the P.

Owing to the relative location of the tension arm shaft 132 and the tension wheel shaft 112, the tension arm 130 is self-energized during the tensioning process to rotate further in a counterclockwise direction about the shaft 132 and to press against the overlapping strap segments U and L with increasing force. As the overlapping strap segments U and L are pressed together between the anvil 146 and the tension wheel 126 during tensioning, the strap segments U and L compress to some degree and this permits the tension arm 130 to rotate even further in a counterclockwise direction about shaft 132. In addition, anvil 146 preferably has a plurality of teeth (not illustrated) which grip and penetrate, to some extent, the lower surface of the lower overlapping strap segment L. As the tension level increases, the teeth on the anvil 146 sink further into the lower strap segment L.

This strap compression and penetration by the anvil 146, of course, aids in preventing the tension wheel 126 from slipping relative to the upper strap segment U. However, this action has the further effect of rotating the arm 130 further about shaft 132 to move upper arm 142 against switch 150. To this end, an abutment means, such as set screw 180 is provided in the tool housing above switch 150. When a predetermined tension level is reached, the compression level of the overlapping strap segments U and L and the penetration of the anvil teeth into the lower strap segment L is sufficient to force the spring plate 154 and actuating member 152 on switch 150 against the set screw 180 to actuate the switch 150 as illustrated in FIG. 4. At any tension below the predetermined tension level, the amount of compression of the overlapping strap segments and the degree of penetration of the anvil teeth into the lower strap segment L is not enough to force the switch 150 against set screw 180 to actuate the switch.

The predetermined tension level can be varied by adjusting the set screw 180. If the set screw 180 is adjusted so that it projects closer to the switch 150 then shown in FIG. 3, then the tension level at which the switch 150 is actuated will obviously be less. Conversely, if the set screw 180 is adjusted so that it is farther from switch 150 than is illustrated in FIG. 3, the tension level at which switch 150 is actuated will be greater.

The spring plate 154 is mouinted in the position illustrated in FIG. 3 and is not intended to be adjustable. The spring plate 154 merely serves to absorb impact energy on the switch actuating member 152, and hence on the switch 150, should the strap loop S break during tensioning.

An operating lever assembly 184 is provided for swinging the tension arm 130 away from the tension wheel 126 to allow the overlapping strap segments U and L to be inserted between the anvil 146 and the tension wheel 126. Operating lever assembly 184 has an operating lever 186, as best illustrated in FIG. 1, and an operating lever cam 188 which has a cam surface 189 adapted to engage roller 160 at the distal end of upper arm 142 on the tension arm 130.

The operating lever assembly 184 is rotatably mounted relative to the tool frame about shaft 190. The operating lever assembly 184 is biased upwardly (counterclockwise about shaft 190 as viewed in FIGS. 1, 3 and 4) by torsion spring 194 coiled around shaft 190. One end 196 of torsion spring 194 is anchored relative to the tool housing and the other end 198 of torsion spring 194 is received in an aperture 200 in the lever cam 188 to urge the operating lever assembly 184 counterclockwise as viewed in FIG. 1.

In the uppermost position, the operating lever assembly 184 is out of contact with the tension arm roller 160 so that the tension arm 130 is free to depress the overlapping strap segments U and L against the tension wheel 126 as illustrated in FIG. 1. When the operating lever 183 is pushed downwardly by the tool operator, the cam surface 189 of the operating lever cam 188 engages the roller 160 and urges the tension arm 130 in a clockwise direction about the shaft 132 to move the anvil 146 away from the tension wheel 126 to allow the insertion of the overlapping strap segments U and L therebetween as illustrated in FIG. 3.

Weld Gripper Pads and Oscillating Drive Means

After the strap loop has been constricted about th package P and tensioned to the predetermined tension level, the rotation of the motor 40 is reversed and a pressing member or gripping weld member, such as upper gripper pad 206, is urged against the top surface of the upper overlapping strap segment U and is oscillated to move the upper strap segment U rapidly relative to the lower strap segment L as best illustrated in FIGS. 4, 6, 9 and 10. Specifically, as is most clearly illustrated in FIGS. 5 and 10, an upper gripper pad 206 is disposed above the overlapping strap segments U and L. Pad 206 is movable between an elevated position illustrated in FIGS. 3 and 5 where it is out of contact with the upper strap segment U and a lowered position illustrated in FIGS. 4 and 7 where it is in contact with the upper strap segment U. In the lowered position illustrated in FIGS. 4 and 7, the upper gripper pad 206 forces the upper strap segment U against the lower strap segment L.

The upper gripper pad 206 preferably has a serrated strap engaging surface, or a plurality of teeth, gripping the upper surface of the upper overlapping strap segment U. The gripper member 206 is mounted to, or is integral with, a frame 212, which frame 212 is mounted to, or is integral with, a ring 214 at one end. The ring 214 is disposed about the first shaft 60. Preferably, a needle bearing 216 is press-fitted to the inside of the ring 214 to allow the ring to easily rotate relative to the shaft 60.

Figure 10:
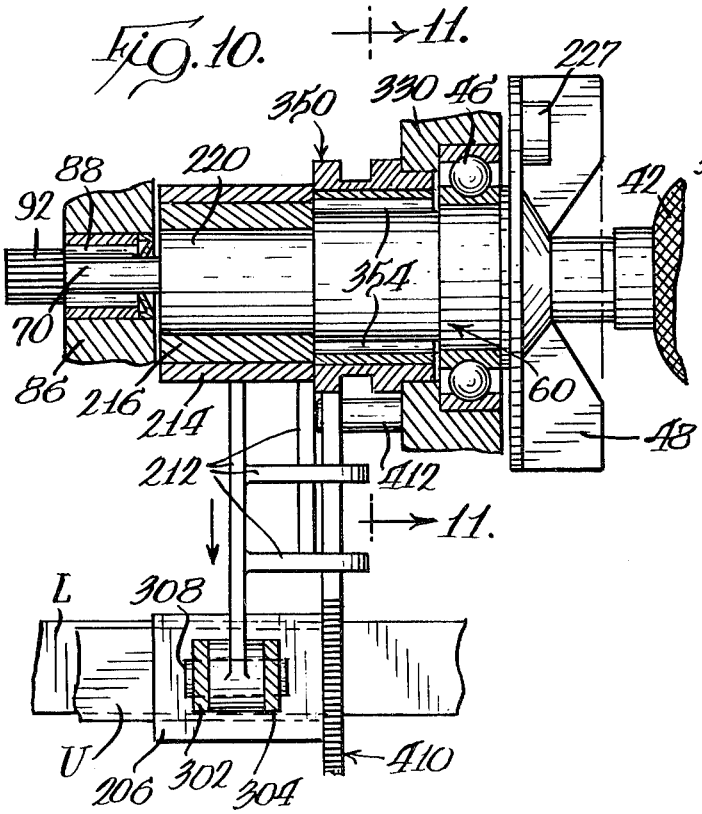
FIG. 10 is a view similar to FIG. 9 but showing the strap pressing member being moved in the direction opposite from that in FIG. 9.

With reference to FIGS. 9 and 10, it can be seen that shaft 60 has a reduced diameter eccentric portion presenting a generally cylindrical drive surface 220 oriented about a longitudinal axis which is parallel to, but displaced from, the coincident longitudinal axes of the shaft 60, of the receiving bore 64 and of the second shaft 70. Thus, as the shaft 60 is rotated, the drive ring 214 is carried in a circular orbit about the longitudinal axis of the shaft 60. Owing to the fact that the ring 214 and bearing 216 secured to ring 214 permit rotation of the eccentric portion of shaft 60, the frame 212 and upper gripper pad 206 can be maintained in the relative positions shown in FIGS. 5 and 6, subject to the oscillating motion in the directions transverse to the length of the strap segments U and L as indicated by the double headed arrow 226 in FIGS. 5 and 6.

It is to be noted that the oscillation of the pad 206 transversely of the overlapping strap segments U and L occurs during the tensioning sequence when the motor 40 is being rotated in the first direction (clockwise as indicated by arrow 228 in FIG. 5) when the gripper pad 206 is in the raised position and out of engagement with the overlapping strap segments as well as when the motor 40 is rotated in the second direction (counterclockwise as indicated by arrow 230 in FIG. 7) during the strap welding sequence and when the upper gripper pad 206 is pressing against the overlapping strap segments U and L.

As illustrated in FIGS. 9 and 10, a balance weight 227 is provided on the fan assembly 48, rotated 180 degrees out of phase with respect to the apogee of the eccentric portion 220 of the drive shaft 60. This provides an overall balanced assembly.

Strap Pressing Mechanism

A means or mechanism responsive to the rotation of the first shaft 60 in the second direction (during the welding sequence) is provided for pressing the overlapping strap segments together after the strap loop has been constricted to the predetermined tension level and for moving at least one of the overlapping strap segments relative to the other strap segment to effect a friction fusion weld of the overlapping segments.

Specifically, with respect to FIGS. 4, 5, 7 and 8, the pressing means or mechanism is seen to include the pressing member or upper gripper pad 206 which is adapted to contact the top surface of the upper overlapping strap segment U. The upper gripper pad 206 is moved between the first, elevated position out of contact with the upper overlapping strap segment U and the second, lowered position in contact with the upper overlapping strap segment U by means of a linkage system comprising a pair of first links 302 and 304 and a rocker arm 306. The links 302 and 304 are pivotably connected at their lower ends to upper gripper pad 206 by means of pin 308 and to rocker arm 306 at their upper ends by means of pin 310.

Figure 7:
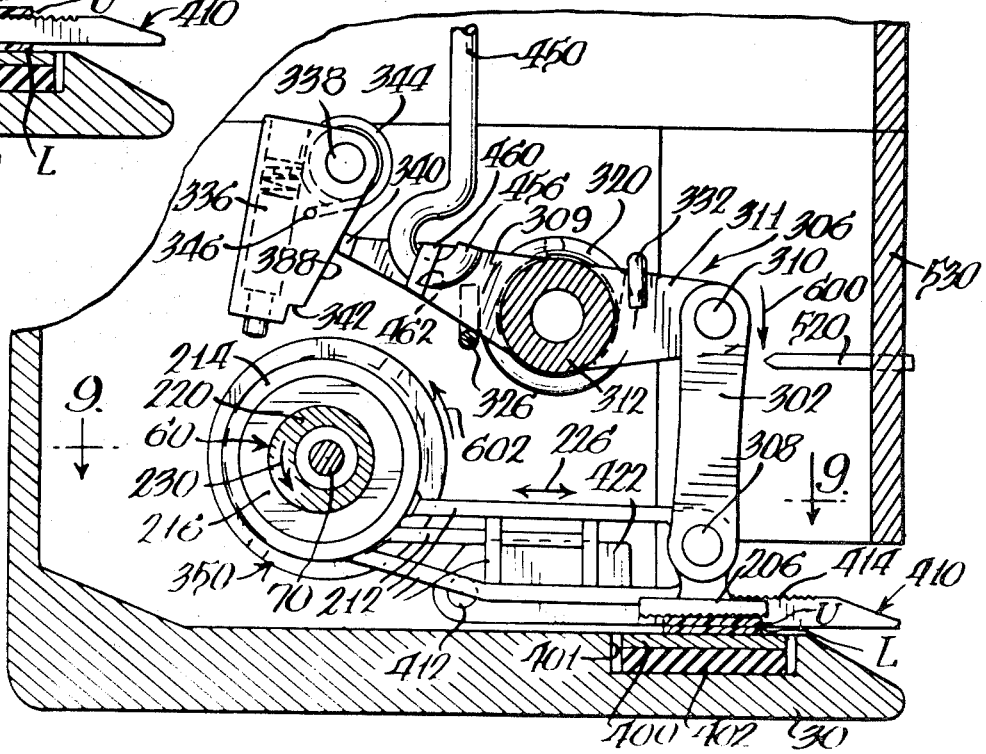
FIG. 7 is a fragmentary, cross-sectional view taken generally along the plane 7—7 in FIG. 4.

Rocker arm 306 has a first end portion 309, a second end portion 311, and an integral shaft 312 which is rotatably mounted at one end in a wall portion 324 of gear housing 32 in receiving bore 314 and at the other end in a wall portion 329 of motor housing 34 in receiving bore 316. A pair of torsion springs, left rocker arm torsion spring 318 and right rocker arm torsion spring 320, are mounted about the shaft 312 to bias the shaft in the clockwise direction as viewed in FIGS. 5 and 6. To this end, spring 318 has an end portion 322 engaged with wall portion 324 of the gear housing and another end portion 326 engaged with the rocker arm first end portion 309. Similarly, the right rocker arm torsion spring 320 has a first end portion 328 engaged with wall portion 329 of the motor housing and another end portion 332 engaged with the rocker arm second end portion 311. In this manner, the rocker arm 306 is continuously biased to urge the pair of links 302 and 304 downwardly to force the upper gripper member 206 against the top surface of the upper overlapping strap segment U as illustrated in FIG. 7.

Figure 5:
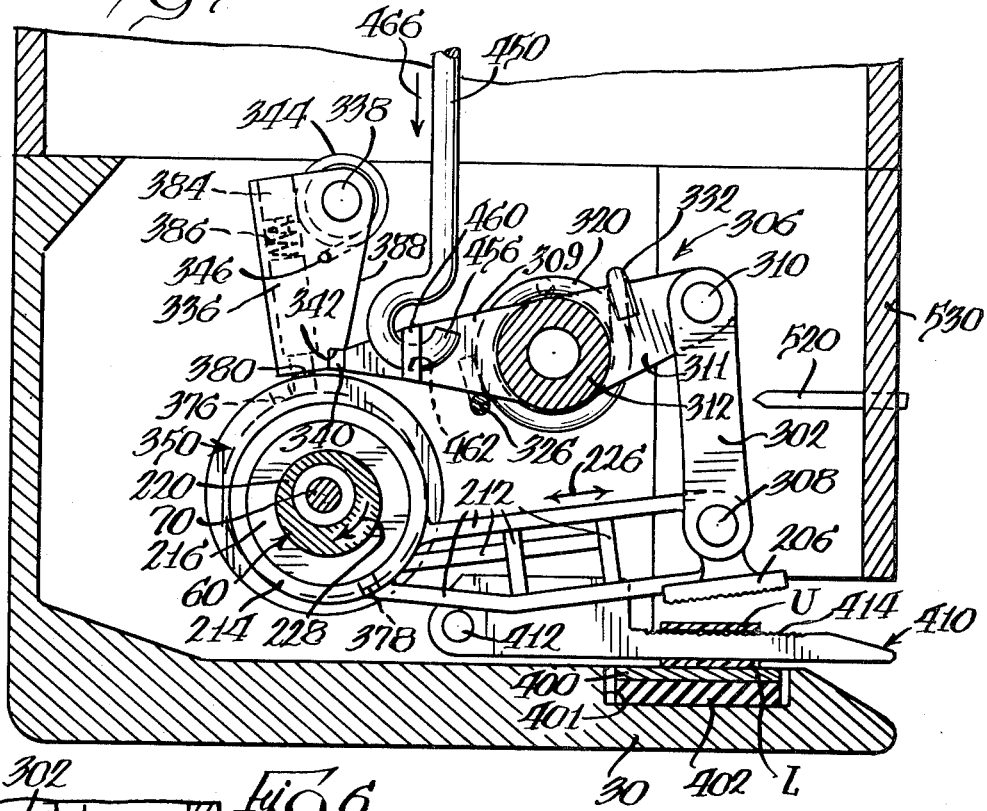
FIG. 5 is a fragmentary, cross-sectional view taken generally along the plane 5—5 in FIG. 3.
Figure 6:
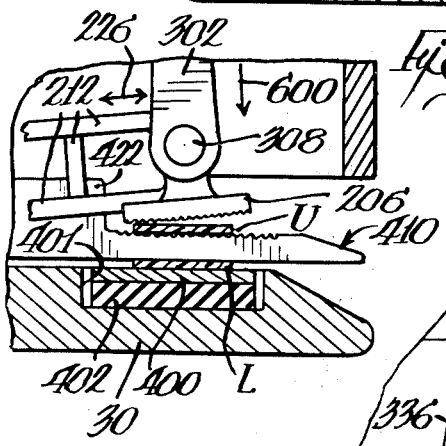
FIG. 6 is a fragmentary, cross-sectional view of the saw blade area of the tool illustrated in FIG. 5 showing the upper overlapping strap segment being pressed against the saw blade.

As illustrated best in FIG. 5, a release pawl 336 is pivotably mounted about a pin 338 to the wall portion 330 of the sealer housing 28 for holding the rocker arm 306 against the bias torque of springs 318 and 320. To this end, the rocker arm 306 has a short outwardly projecting leg 340 on the rocker arm first end portion 309 and the release pawl 336 has a cut-out notch 342 (best illustrated in FIG. 7) for receiving the leg 340 and functioning as a latch means for engaging the rocker arm 306 to hold it in the orientation illustrated in FIG. 5 wherein the upper gripper pad 206 is in the first, elevated position out of contact with the strap. To hold the release pawl 336 in the position illustrated in FIG. 5 wherein the rocker arm 306 is engaged, a release pawl spring 344 is provided and has a first end portion 346 engaging the release pawl 336 and a second end portion 348 (best viewed in FIG. 8) secured to wall portion 330 of sealer housing 28. Thus, spring 344 urges the release pawl 336 about shaft 338 in a counterclockwise direction (as viewed in FIG. 5) to engage the rocker arm 306.

Figure 11:
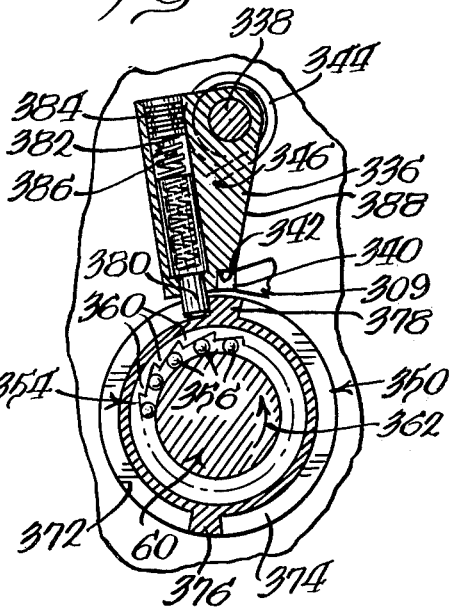
FIG. 11 is a fragmentary, cross-sectional view of the release ring and pawl mechanism illustrated in FIG. 5, but with the first drive shaft rotating in the direction opposite from that illustrated in FIG. 5.

The release pawl 336 is moved in a clockwise direction about shaft 338 (as viewed in FIG. 7) to release and disengage the rocker arm 306 by means of a release ring 350 disposed about shaft 60. As best illustrated in FIGS. 10 and 11, a release ring clutch 354 is disposed between the shaft 60 and release ring 350. The clutch 354 is a one way clutch similar to the one way clutches 76 and 78 between the first shaft 60 and the second shaft 70 previously described and illustrated in FIG. 9.

With reference to FIG. 11, the one way clutch 354 is seen to comprise a plurality of roller pins 356 and an outer driven member 358 having teeth 360 adapted to be bound by the rollers 356 when the first shaft 60 is rotated in the counterclockwise direction (indicated by arrow 362 in FIG. 11) so that the driven clutch member 358 rotates counterclockwise also with the first shaft 60 to rotate the release ring 350 in the counterclockwise direction.

When the motor 40 and shaft 60 are rotated in the first direction to constrict the strap loop (clockwise as indicated by arrow 228 in FIG. 5) the release ring clutch 354 disengages the release ring 350 from the drive shaft 60 so that the drive shaft 60 rotates in that first direction without rotating the release ring 350.

The release ring 350 defines a circumferentially interrupted groove or pair of peripheral grooves 372 and 374 which are separated by wall portions or lugs 376 and 378. The release pawl 336 is adapted to engage one of the lugs 376 and 378 by means of a plunger 380 projecting downwardly from the release pawl 336. The plunger 380 is received in the lower end of a bore 382 within release pawl 336. A plug 384 is retained in the upper end of bore 382 by means of a press fit. A compression spring 386 is disposed within the bore 382 between the plug 384 and the top of the plunger 380 to bias the plunger 380 downwardly into one of the grooves 372 and 374 defined in the release ring 350. The plunger bore and spring structure cooperate with the tool reset mechanism in a manner explained hereinafter in the section entitled "Reset Mechanism."

With reference to FIG. 5, when the motor 40 rotates the shaft 60 in the clockwise direction indicated by arrow 228 to constrict and tension the strap loop, the release ring 350 is not driven by the shaft 60 because the clutch 354 is disengaged in that direction of rotation. To the extent that there is some transmission of rotational friction forces from the drive shaft 60 through the clutch 354 to the release ring 350, the release ring 350 may be rotated in the clockwise direction until a lug, say 376, abuts the downwardly projecting plunger 380. However, since the clutch is not engaged to drive the release ring 350, the lug 376 is only lightly forced against the plunger 380, thus stopping the further rotation of the release ring 350 while the drive shaft 60 continues to rotate.

When the strap loop S has been constricted about the package P and the direction of the motor is reversed to begin the welding sequence, the shaft 60 rotates in the counterclockwise direction indicated by arrow 362 in FIG. 11. The clutch 354, now engaging the release ring 350 with the drive shaft 60, causes the release ring 350 to rotate with the drive shaft 60 in the counterclockwise direction to bring one of the lugs, say lug 378, against the side of plunger 380. Since only the side of the plunger 380 is contacted by lug 378, the plunger is not forced upwardly in the bore 382 of the pawl 336, but is forced laterally out of the release ring groove 372. This causes the release pawl 336 to overcome the bias of the torsion spring 344 and to rotate in the clockwise direction about the shaft 338 to thereby disengage the rocker arm leg 340 from the release pawl latch means or notch 342. Upon disengagement from the release pawl 336, the rocker arm 306 is rotated about shaft 312 by the torsion springs 318 and 320 (in the clockwise direction as viewed in FIG. 7) to force the upper gripper member 206 against the overlapping strap segments.

The release pawl 336 is maintained out of contact with the still rotating release ring 350 by the unlatched rocker arm 306. To this end, the release pawl 336 has a camming surface 388 against which rocker arm leg 340 slides to its upwardmost position (FIG. 7).

The cam surface 388 of the release pawl 336 is thus engaged by the rocker arm leg 340 to hold the release pawl outwardly against the biasing force of the torsion spring 344 and to maintain the release pawl plunger 380 out of engagement with the rotating release ring 350.

Although only one release ring lug would be required, two release ring lugs 376 and 378 are provided for balance purposes since the release ring 350 rotates along with the drive shaft 60 in the second direction of rotation during the strap welding sequence.

It is to be remembered that the gripper member 206, being mounted to the oscillating drive ring 214 on the drive shaft 60, is continuously reciprocating in the direction transverse to the strap length as indicated by arrow 226 in FIG. 7. As the overlapping strap segments U and L are forced together by the reciprocating upper gripper pad 206, the segments are friction fused together to form the joint (seal) in the strap loop.

With reference to FIG. 7, it can be seen that as upper gripper pad 206 reciprocates in the direction of arrow 226, it is also tilted upwardly, relative to the flat surfaces of the strap, by the action of the oscillating ring 214. To accommodate this slight tilting effect of the upper gripper pad 206, and to ensure that the strap segments are pressed together with relatively uniform pressure, a movable lower gripper pad 400 is provided below the strap segments U and L. Pad 400 has a serrated or toothed surface (not illustrated) adapted to contact the bottom surface of the lower overlapping strap segment L. The lower gripper pad 400 is mounted within a notch 401 in base 30 of the tool 20 on top of a resilient support pad 402. The support pad 402 is preferably made of 50 durometer urethane. Thus, when the upper gripper pad 206 is tilted upwardly slightly by the action of the oscillating ring 214, the resilient pad 402 permits the entire sandwich configuration of the overlapping strap segments U and L and the support pad 400 to tilt with the upper gripper pad 206.

Strap Severing Mechanism

As best illustrated in FIGS. 5, 6, 7, 8, 9, and 10, a saw blade 410 is provided just rearwardly of the lower gripper pad 400. As best illustrated in FIGS. 5 and 7, the saw blade 410 is pivotably mounted about a pin 412 to the tool housing and has a plurality of upwardly projecting saw teeth 414 which are adapted to contact the bottom surface of the upper overlapping strap segment U and cut through that upper strap segment as the upper strap segment is forced downwardly against the lower strap segment L by the upper gripper member 206 at the beginning of the welding sequence. To this end, when the strap loop is formed about the package P and when the overlapping strap segments U and L are placed in the machine as illustrated in FIG. 1, the trailing portion T of the strap is placed over the top of the saw blade 410 while the lower overlapping strap segment L is placed beneath the saw blade 410.

A saw blade 410 is preferably mounted on pin 412 to permit sliding of the saw blade parallel to shaft 60 forwardly or rearwardly relative to the upper and lower gripping pads 206 and 400, respectively. The saw blade 410 is maintained in a given position relative to the upper gripper pad 206 by extensions of frame members 212 which define notches 420 (FIG. 4) in which a rear portion 422 of the saw blade 410 is slidably disposed. Thus, the frame 212 (and upper gripper pad 206) can oscillate in the direction of the arrow 226 (FIGS. 5 and 6) relative to the saw blade 410. However, any movement of the frame 212 forwardly or rearwardly in the tool (parallel to the drive shaft 60) will carry the saw blade 410 forwardly or rearwardly with the frame 212.

Reset Mechanism

After the overlapping strap segments have been sealed together by the friction fusion weld, the tool may be reset to raise the upper gripper pad 206 to the first elevated position out of contact with the overlapping strap segments to permit the tool to be removed from the sealed strap loop and to be used again to tension and seal another strap loop about the same package or about a different package.

As shown in FIGS. 4 and 5, the operating lever cam 188 of the operating lever assembly 184 is adapted to actuate a reset link 450 which is engaged with the rocker arm 306. With reference to FIG. 4, the operating lever cam 188 is seen to be oriented in its normally, spring-biased position out of contact with the tension arm 130 whenever the overlapping strap segments U and L are being joined by a friction fusion weld. The operating lever cam 188 defines an arcuate guide slot 454 for receiving an L-shaped upper end portion 455 of the link 450.

The link 450 has another end portion 456 which is C-shaped and is engaged with the rocker arm first end portion 309 as best illustrated in FIGS. 7 and 8. Specifically, the first end portion 309 of the rocker arm 306 has an extension 460 defining a bore 462 through which the link end portion 456 passes and by means of which the link 450 is secured to the rocker arm 306.

When the rocker arm 306 is in the orientation illustrated in FIG. 7 during the friction fusion welding sequence, the reset link 450 is urged to its upwardmost position by the rocker arm 306 so that the upper end 456 of link 450 (FIG. 4) is positioned near the top of the operating lever guide channel 454. The operating lever assembly 184 is of course normally biased upwardly and is thus out of contact with the tension arm roller 160 as clearly illustrated in FIG. 4.

After the friction fusion weld has been completed and the motor deenergized, the tool may be removed from the sealed strap loop by pressing the operating lever 186 downwardly. This causes the anvil 46 to swing away from the tension wheel 126 and causes the reset link 450 to be urged downwardly in the direction of arrow 466 in FIG. 5 to bring the leg 340 of the rocker arm 306 into engagement with the latch means 342 on the latch pawl 336.

As the release pawl 336 rotates back into engagement with the leg 340 on the rocker arm 306, the plunger 380 enters one of the grooves 372 or 374 (FIG. 11) of the release ring 350. Since the motor is deenergized, the release ring 350 and shaft 60 will have stopped their rotation. The release ring lugs 376 and 378 (FIG. 11) could be oriented in any position. If one of the lugs had stopped right below the point where the plunger 380 swings into the release ring grooves 372 or 374, the plunger 380 would hit that lug. However, the compression spring 386 is designed to permit the plunger 380 to be forced upwardly by the lug as the release pawl 336 rotates counterclockwise about shaft 338 under the biasing force of torsion spring 344. This ensures that the release pawl 336 will always come down to the normal latched position in engagement with the leg 340 on rocker arm 306 when the tool is reset by the downward movement of link 350 in response to the downward movement of operating lever assembly 184.

Since the downward movement of the operating lever assembly 184 is necessary to pivot the tension arm 130 away from the tension wheel 126 to release the overlapping strap segments, it is seen that the tool is automatically reset whenever the tool is removed from the sealed strap loop.

When the tool 20 is next engaged with overlapping strap segments of a new strap loop (as illustrated in FIG. 1), the operating lever assembly 184 is, of course, biased by the spring 194 in the counterclockwise direction about shaft 190 so that the upper end of reset link 450 assumes a position near the bottom of the guide channel 452. The length and shape of the guide channel 452 is such that the reset link 450 is not pulled upwardly by the cam segment 188 during the tensioning process. Thus, the link 450 exerts no force upon the rocker arm 306.

As best illustrated in FIG. 2, a convenient momentary contact button 500 is provided in the side of the tool housing to actuate contact member 502 of a cycle starting switch 504. The cycle starting switch 504 is part of the overall control circuit for operating the electric motor 40 and a friction fusion weld sequence timer (not illustrated). The friction fusion weld sequence timer is actuated when the motor 40 reverses from the first direction of rotation (during tensioning) to the second direction of rotation (during welding) and operates the motor for the predetermined period of time necessary to achieve a good friction fusion weld in the overlapping strap segments.

Should the reset mechanism accidentally fail and release the upper gripper pad 206 from the elevated position after removal of the welded strap from the tool, an abutment member, such as screw 520 is provided in the housing side wall portion 530 to limit the downward travel of the rocker arm 306 and hence, of the upper gripper pad 206. The rocker arm 306 would come to rest on the end of screw 520 and prevent the upper gripper pad 206 from contacting the lower gripper pad 400. This eliminates the possibility of damaging the teeth on either or both gripper pads.

Sequence of Operation

Although the operation of the tool 20 is believed to be easily understood from the description of the various mechanisms comprising the tool presented above, a brief summary of the sequence of operation will be given here for completeness.

The tool 20 is initially placed against the surface of a package P as illustrated in FIG. 1 and the operating lever 186 is pushed downwardly to swing the tension arm 130 outwardly away from the tension wheel 126. The strap is placed around the package P with overlapping strap segments U and L inserted between the anvil 146 of the tension arm 130 and the tension wheel 126. The operating lever is then released so that the tension arm 130 is pivoted to force the anvil 146 against overlapping strap segments U and L and press them against tension wheel 126.

Of course, as the operating lever 186 is pushed downwardly when the overlapping straps are inserted into the tool, if for some reason the tool had not been previously reset, the reset link 450 will be moved downwardly. This urges the rocker arm 306 (FIG. 5) into engagement with the latch notch 342 of the release pawl 336 and this raises the upper gripper pad 206 to the elevated position out of contact with the strap segments.

The pressing of button 500 (FIG. 2) actuates the control system of the tool 20 and the motor 40 begins to rotate in the first direction (clockwise with reference to FIG. 2) to rotate the shaft 60 and, through clutches 76 and 78, shaft 70 and pinion 92 in the clockwise direction.

The pinion 92 on the end of the second shaft 70 rotates the ring gear 106 which rotates shaft 100 to rotate spiroid worm gear 108. Gear 120, engaged with spiroid worm gear 108, is thus driven to rotate shaft 112 to turn the tension wheel 126 in the counterclockwise direction as viewed in FIG. 1 to pull the upper overlapping strap segment U relative to the lower overlapping strap segment L for constricting the strap loop S about the package P and to tension the loop.

As tension is pulled in the strap loop, the self-energizing action of the tension arm 130 forces the anvil 146 further towards the tension wheel 126 as the straps compress between the wheel 126 and the anvil 146 and as the teeth of the anvil 146 dig into the bottom strap segment L. This causes the tension arm 130 to rotate slightly further in the counterclockwise direction about shaft 132 to swing the tension sensing switch 150 against the screw 180 to actuate switch 150 at the predetermined tension level. This reverses the rotation of the motor 40. Owing to the clutch 88 (FIGS. 9 and 10), the second shaft 70 is prevented from rotating back in the direction that would tend to loosen the strap tension.

When the rotation of shaft 60 is reversed from the first direction to the second direction, the release ring clutch 354, previously disengaged, engages the release ring 350 with the shaft 60 so that the shaft 60 rotates the release ring 350 in the second direction (counterclockwise as indicated by arrow 362 in FIG. 11).

Rotation of the drive shaft 60 and release ring 350 in the second direction causes one of the release ring lugs (e.g., lug 378) to pivot the release pawl 336 to unlatch the rocker arm 306. As illustrated in FIG. 7, the rocker arm 306 then pivots in a clockwise direction (arrow 600) with its shaft 312 to force the upper gripper pad 206 downwardly against the top surface of the upper overlapping strap segment U.

Owing to the rotation of the eccentric surface 220 of shaft 60, the drive ring 214 oscillates in a circular path in the direction of arrow 602 illustrated in FIG. 7 and thus imparts an oscillating motion to upper gripper pad 206. Owing to the restraint of the rocker arm 306 which transmitted through links 302 and 304 to the upper gripper pad 206, upper gripper pad 206 is primarily reciprocated in a direction indicated by arrow 226 in FIG. 7. This direction is transverse to the length of the overlapping strap segments U and L. The upper overlapping strap segment U, which is gripped by the gripper pad 206, is thus moved transversely with respect to the lower overlappping strap segment L to form a friction fusion weld.

During this reciprocating movement, the upper gripper pad 206 tends to tilt upwardly (on the left end of the pad as viewed in FIG. 7) because of the small upward oscillation of the ring 214 on the eccentric portion of shaft 60. This slight tilting motion of pad 206 is accommodated by the lower gripping pad 400 which, though rigid, tilts with upper pad 206 on the resilient support pad 402. In this manner, the upper and lower gripper pads 206 and 400 remain substantially parallel at all times during the welding sequence with the overlapping strap segments U and L pressed generally uniformly between them.

As the upper gripper pad 206 is lowered against the upper overlapping strap segment U, the bottom surface of the upper overlapping strap segment U is forced against the saw teeth 414 of the saw blade 410. The reciprocating motion of the upper overlapping strap segment U relative to the saw blade 410 causes the trailing portion T (FIG. 1) of the strap to be severed from the strap loop S before the overlapping strap segments U and L are joined by the friction fusion weld.

The motor 40 is rotated in the second direction to effect the friction fusion weld for a predetermined period of time, as governed by the weld sequence timer in the control system, following which the motor rotation is terminated.

The tool 20 is next removed from the tensioned and sealed strap loop by pressing downwardly on the operating lever 186 so that the operating lever cam 188 contacts the roller 160 and pivots the tension arm 130 to move the anvil 146 away from the tension wheel 126. This permits the tool to be moved laterally away from the overlapping strap segments U and L.

The downward movement of lever 186 and of the operating lever cam 188 also causes the upper end of the guide channel 452 to engage the upper end 455 of the reset link 450 (FIG. 3) and to move the reset link 450 downwardly as illustrated by arrow 466 in FIG. 5. This causes the rocker arm 366 to pivot from the unlatched position illustrated in FIG. 7 to the latched position illustrated in FIG. 5 whereat the release pawl 336, urged by the torsion spring 344, engages the leg 340 of the rocker arm and whereat the plunger 380 in the release pawl 336 enters one of the grooves 372 or 374 in the release ring 350. If the entry into the grooves 372 or 374 is blocked by one of the lugs 376 or 378, the plunger 380 is forced upwardly against the compression spring 386 in bore 382 of the release pawl 336.

The tool 20 is now reset and when the downward force on the operating lever 186 is removed, the entire operating lever assembly 184 is biased upwardly by the torsion spring 184 to the position illustrated in FIG. 1. In this position, the upper portion 456 of the reset link 450 rests near the bottom of the guide channel 454 and the tension arm 130 is biased by its torsion spring 166 so that anvil 146 is forced against the tension wheel 126. Downward movement of the operating lever 186 will cause the anvil 146 to move away from the tension 126 to again allow the tool to be loaded with overlapping strap segments U and L to begin another strapping sequence.

ALTERNATE SAW BLADE EMBODIMENT

A second embodiment of the saw blade used in the tool 20 will next be described with reference to FIGS. 12–15. All of the components of the tool 20 remain the same as in FIGS. 1–11 except for the saw blade structure and supporting elements as will be explained in detail hereinafter. Consequently, all of the elements, except for the elements relating to the saw blade and support elements, are illustrated in FIGS. 12–15 as being identical to the elements of the tool 20 illustrated in FIGS. 1–11 and those elements retain the same reference numerals.

Figure 12:
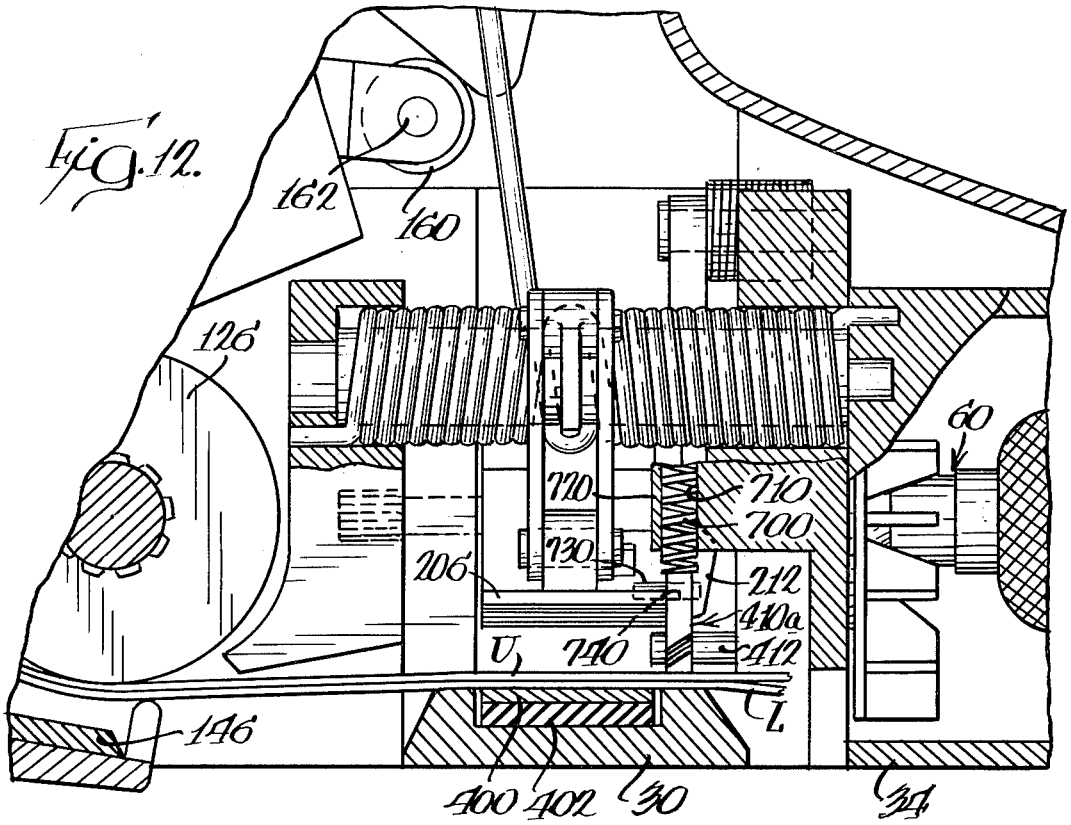
FIG. 12 is a fragmentary, cross-sectional view similar to FIG. 3 but showing the tool with a second embodiment of a saw blade and with the pressing member and saw blade in the elevated, strap-receiving position.
Figure 13:
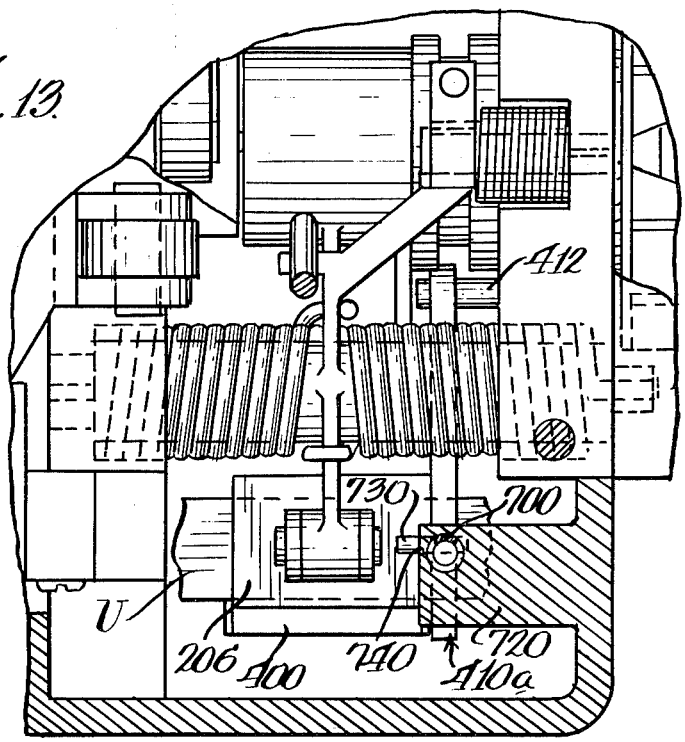
FIG. 13 is a fragmentary view similar to FIG. 8, but showing the tool of FIG. 12 with the second embodiment of the saw blade.
Figure 14:
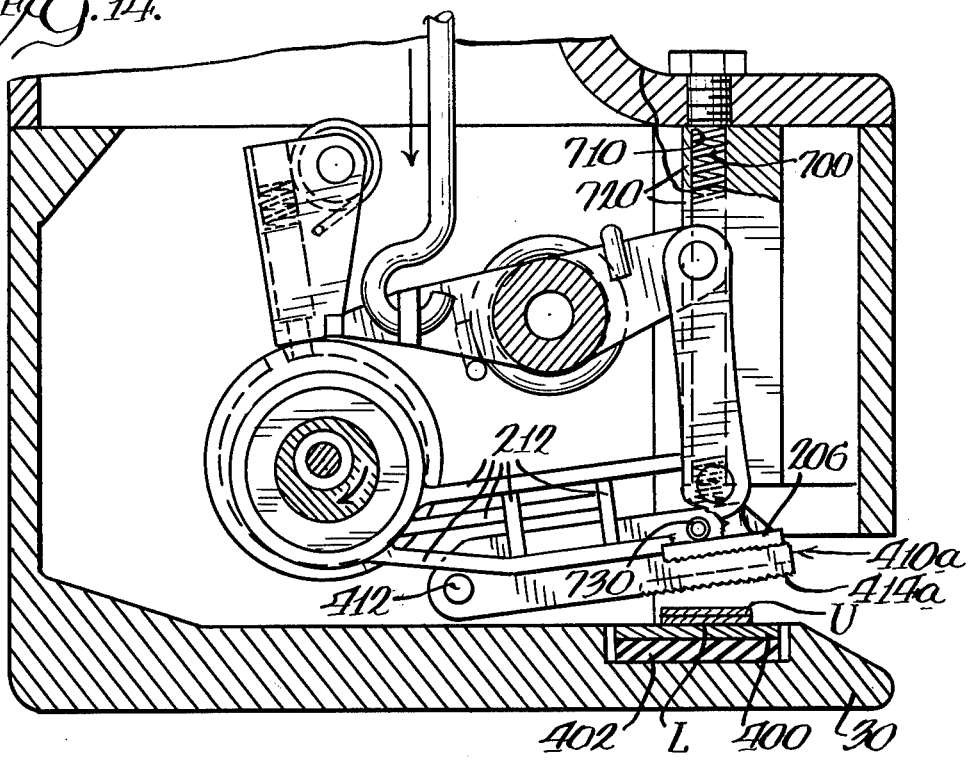
FIG. 14 is a view similar to FIG. 5 but showing the tool of FIG. 12 with the second embodiment of the saw blade in the elevated position.

The alternate saw blade is designated generally in FIGS. 12–15 by reference numeral 410*a*. As best illustrated in FIG. 14, the saw blade 410*a* is mounted on pin 412 in the same manner as the first embodiment of the saw blade 410 described in detail above. The saw blade 410*a* is permitted to slide along the pin 412 parallel to the shaft 60 forwardly or rearwardly relative to the upper and lower gripping pads 206 and 400, respectively. The saw blade 410*a* is also adapted to pivot about the pin 412 between a lowered, strap-contacting position illustrated in FIG. 15 and a raised, strap loading and tensioning position illustrated in FIG. 14.

The saw blade 410*a* has a plurality of downwardly projecting saw teeth 414*a* which are adapted to contact the upper surface of the upper overlapping strap segment U and which are adapted to cut through that upper strap segment U in a manner to be described in more detail hereinafter.

Figure 15:
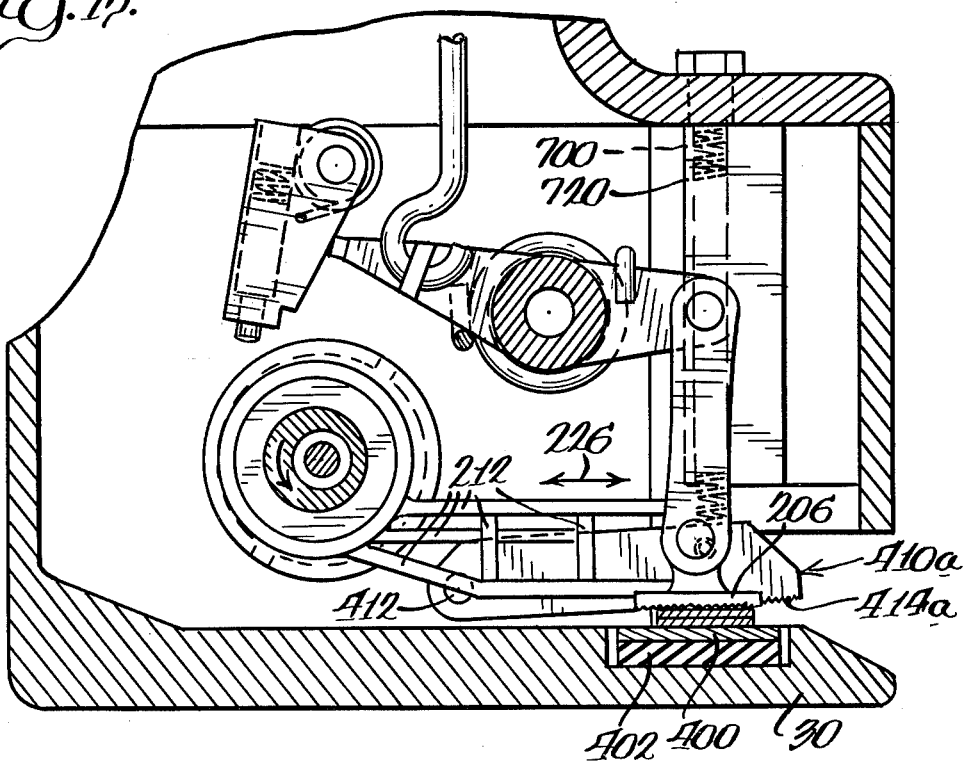
FIG. 15 is a view similar to FIG. 7 but showing the tool of FIG. 12 with the second embodiment of the saw blade in the lowered position.

As best illustrated in FIGS. 12, 14, and 15, a helical compression spring 700 is disposed in a cylindrical bore 710 of a downwardly depending portion 720 of the tool side cover. A portion of the spring 700 projects from the bore 710 with the distal end of the projecting spring portion bearing upon, but not connected to, the top horizontal surface of the saw blade 410*a*. The spring thus exerts a continuous downward bias force against the saw blade 410*a*.

As illustrated best in FIG. 15, with the saw blade 410*a* downwardly biased, the teeth 414*a* are in contact with the upper surface of the upper overlapping strap segment U. Movement of the upper strap segment U, in directions of the double headed arrow 226 parallel to the length of the saw blade during the friction fusion welding sequence (by means of the oscillating upper gripper pad 206), will cause the upper strap segment U to be severed.

As best illustrated in FIGS. 12 and 13, the forward portion of the saw blade 410*a* carries a pin 730. The pin 730 is preferably a spring roll pin received within a cylindrical bore 740 in the saw blade 410*a*. The spring roll pin 730 projects forwardly over the top of the upper gripper pad 206 and is adapted to be engaged by the top surface of the upper gripper pad 206 when the upper gripper pad 206 is raised upwardly away from the overlapping strap segments U and L. Raising of the upper gripper pad 206 will thus lift the saw blade 410*a* away from the overlapping strap segments U and L and will hold the saw blade 410*a* in the raised position until the upper gripper pad 206 is again lowered into contact with the upper strap segment U.

The spring roll pin 730 of the saw blade 410*a* is not connected to the upper gripper pad 206. Thus, when the upper gripper pad 206 is lowered into engagement with the upper strap segment U, the saw blade 410*a* is not pulled downwardly by the upper gripper pad 206. Rather, the blade 410*a* is urged to fall against the upper strap segment U under the influence of gravity and by the small downward force applied to the saw blade 410*a* by the compression spring 700. This causes the saw blade to contact and quickly cut the upper strap segment U when the upper strap segment U is reciprocated against the overlying, lowered blade by the fully lowered upper gripper pad 206.

By appropriate design, such as by taking into account the spring constant of the spring 700 and the length of the spring, the downward bias force on the saw blade 410*a* can be made relatively constant and of sufficient magnitude to provide an effective sawing action without causing a deleterious impingement of the saw blade upon the lower strap segment L after the upper strap segment U has been severed. It is to be remembered that the lower strap segment L is substantially immobile during the friction fusion welding process. Further, since the saw blade 410*a* does not oscillate, there can be no sawing or severing of the lower strap segment L by the saw blade 410*a* after the upper strap segment U is cut through by the saw blade.

The position of the spring roll pin 730 in the vertical direction relative to the saw blade teeth 414*a* is preferably chosen so that the saw blade teeth 414*a* contact the upper surface of the upper strap segment U before the upper gripper pad 206 contacts the upper surface of the upper strap segment U. Thus, the saw blade is already engaged with the upper strap segment when the upper gripper pad 206 finally contacts and reciprocates the upper strap segment U.

In the preferred design, it has been found that the upper strap segment U is severed by the time the upper strap segment U has been reciprocated for about 75 percent of the total friction fusion welding period. That is, after the upper strap segment U has been severed, the upper gripper pad 206 continues to oscillate and move the severed end portion of the upper strap segment U against the lower strap segment L for an additional period of time to complete the weld. That additional weld completion time is equivalent to 25 percent of the total friction fusion welding time that the upper and lower strap segments U and L, respectively, are oscillated in contact.

It has been found that the above-described saw blade design provides a number of advantages. One advantage is a savings in operator labor when used with many types of plastic strap. Specifically, when the trailing portion of the upper strap segment U is severed, it tends to remain lightly stuck to the saw blade and/or to the loop portion of the upper strap segment with pieces of melted thermoplastic material from the adjacent friction fusion weld. The severed trailing portion of the upper strap segment U will thus remain with the tool 20 rather than fall out of the tool or be pulled out by the prestressed coil of strap behind the tool. Then, the operator can grab the "sticking," severed, trailing portion of the strap after the weld has been completed and, with just a small amount of force, can pull it out of the tool and away from the fused joint. The operator is then able to thread the trailing portion of strap, which he has just removed and has in his hand, around another package and back into the tool 20. Were it not for the severed trailing portion of the strap sticking in the tool with the melted plastic, the severed strap would fall out of the tool and the operator would have to bend down and pick up the strap in preparation for encircling another package with the strap.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

It is claimed:

1. A tool for constricting and closing a loop of thermoplastic strap that encircles an article and has overlapping strap segments, said tool comprising:

means for constricting said loop;

reversible motor means for rotating initially in a first direction and then in a second, opposite direction;

drive shaft means driven by said reversible motor means sequentially in said first and second directions of rotation for engaging and operating said constricting means to constrict said strap loop only when said drive shaft means is rotated in said first direction;

sensing and control means for sensing a predetermined level of tension in the constricted strap loop and for reversing the rotation of said motor means to change the rotation of said drive shaft means from said first direction of rotation to said second direction of rotation; and means responsive to rotation of said drive shaft means in said second direction for pressing said overlapping strap segments together after said strap loop has been constricted to said predetermined tension level and for moving at least one of said overlapping strap segments relative to the other strap segment to effect a friction fusion weld of said overlapping segments.

2. The tool in accordance with claim 1 in which said drive shaft means includes a first shaft connected to and driven by said motor means, in which said constricting means includes at least a second shaft, and in which said drive shaft means further includes clutch means drivably connecting said first shaft with said second shaft for rotating said second shaft in said first direction to constrict said loop and adapted to disengage said second shaft from said first shaft when said first shaft is rotated in said second direction.

3. A tool for tensioning a loop of thermoplastic strap and sealing overlapping strap segments about an article, said tool comprising:

a first rotatably mounted shaft;

reversible motor means for rotating said first shaft initially in a first direction and then in a second, opposite direction;

a second, rotatably mounted shaft;

tension means drivably engaged with said second shaft for tensioning said loop;

first clutch means drivably connecting said first shaft with said second shaft for rotating said second shaft in said first direction to tension said loop and adapted to disengage said second shaft from said first shaft when said first shaft is rotated in said second direction;

sensing and control means for sensing a predetermined level of tension in said strap loop and for reversing the rotation of said motor means to change the rotation of said first shaft from said first direction of rotation to said second direction of rotation; and means responsive to rotation of said first shaft in said second direction for pressing said strap segments together after said strap loop has been tensioned to said predetermined level and for moving at least one of said overlapping strap segments relative to the other strap segment to effect a friction fusion weld of said overlapping segments.

4. A tool for tensioning a loop of thermoplastic strap and sealing overlapping strap segments, about an article, said tool comprising:

a first rotatably mounted shaft;

reversible motor means for rotating said first shaft initially in a first direction and then in a second, opposite direction;

a second rotatably mounted shaft;

transmission means drivably engaged with said second shaft;

tension wheel means engaged with said transmission means for tensioning said loop;

first clutch means drivably connecting said first shaft with said second shaft for rotating said second shaft in said first direction to tension said loop and adapted to disengage said second shaft from said first shaft when said first shaft is rotated in said second direction;

sensing and control means for sensing a predetermined level of tension in said strap loop and for reversing the rotation of said motor means to change the rotation of said first shaft from said first direction of rotation to said second direction of rotation;

means responsive to rotation of said first shaft in said second direction for pressing said overlapping strap segments together after said strap loop has been tensioned to said predetermined level; and oscillating drive means on said first shaft for oscillating said strap pressing means to move one of said overlapping strap segments relative to the other overlapping strap segment to effect a friction fusion weld of said overlapping segments.

5. A tool for tensioning and sealing a loop of thermoplastic strap that encircles an article and has first and second overlapping strap segments, said tool comprising:

a frame;

a first shaft mounted for rotation about its longitudinal axis relative to said frame;

a reversible motor carried by said frame for rotating said first shaft sequentially in first and second directions;

a second shaft mounted for rotation about its longitudinal axis relative to said frame;

tension means mounted to said frame for tensioning said loop;

means drivably connecting said second shaft with said tension means;

first clutch means drivably connecting said first shaft with said second shaft for rotating said second shaft in said first direction to tension said loop and adapted to disengage said second shaft from said first shaft when said first shaft is rotated in said second direction;

means for sensing a predetermined level of tension in said strap loop;

control means responsive to said loop tension sensing means for reversing the rotation of said motor from said first direction of rotation to said second direction of rotation when said predetermined loop tension level is sensed by said tension sensing means;

means responsive to rotation of said first shaft in said second direction for pressing said first and second overlapping strap segments together after said strap loop has been tensioned to said predetermined level; and oscillating drive means on said first shaft for oscillating said strap pressing means to move said first overlapping strap segment generally transversely of the strap length relative to the second overlapping strap segment to effect a friction fusion weld of said overlapping segments.

6. The tool in accordance with claim 5 in which said oscillating drive means includes (a) an eccentric portion on said first shaft having a generally cylindrical exterior drive surface oriented about a longitudinal axis parallel to, but displaced from, said first shaft longitudinal axis and (b) a driven ring member mounted on said eccentric portion of said first shaft and having a generally cylindrical inner driven surface disposed on said generally cylindrical exterior drive surface of said eccentric portion to permit movement of said ring member with said eccentric portion while allowing rotation of said eccentric portion relative to said ring member; and in which said pressing means includes a pressing member mounted to said driven ring member for contacting said first overlapping strap segment whereby rotation of said first shaft oscillates said pressing member.

7. The tool in accordance with claim 6 in which said pressing means further includes:

a rocker arm pivotably mounted on said frame and having first and second end portions;

link means pivotably connected at one end to said rocker arm second end portion and pivotably connected at the other end to said pressing member;

rocker arm spring means urging said rocker arm to pivot relative to said frame to force said pressing member against said first overlapping strap segment;

a release pawl pivotably mounted on said frame and having a latch means for engaging said rocker arm first end portion;

a release pawl spring means for urging said release pawl against said rocker arm first end portion to engage said latch means;

a release ring member mounted about said first shaft and adapted to engage said release pawl; and second clutch means drivably connecting said first shaft with said release ring member for rotating said release ring member with said first shaft in said second direction to move said release pawl latch means out of engagement with said rocker arm first end portion and adapted to disengage said release ring member for said first shaft when said first shaft is rotated in said first direction whereby, when said first shaft is rotated in said second direction, said second clutch means is engaged and said release ring member rotates in said second direction to force said release pawl to pivot away from said rocker arm first end portion and release said rocker arm first end portion from said release pawl latch means so that said rocker arm is urged by said rocker arm spring means to force said pressing member against said first overlapping strap segment.

8. The tool in accordance with claim 7 further including reset link means secured to said rocker arm for being forced in one direction to pivot said rocker arm against the urging of said rocker arm spring to bring said rocker arm first end portion into engagement with said latch means.

9. The tool in accordance with claim 5 further including a tension holding clutch means mounted to said frame for permitting rotation of said second shaft in only said first direction.

10. The tool in accordance with claim 5 in which said tension means includes a tension wheel shaft mounted to said frame for rotation relative thereto and a tension wheel mounted on said tension wheel shaft for rotation therewith and in which said means drivably connecting said second shaft with said tension means includes a gear transmission drivably connecting said tension wheel shaft and said second shaft.

11. The tool in accordance with claim 10 further including a tension arm pivotably mounted to said frame, said tension arm having a tension foot adjacent said tension wheel, and a tension arm spring means urging said tension arm to pivot relative to said frame to urge said tension foot toward said tension wheel to thereby press said first and second overlapping strap segments between said tension wheel and said tension foot.

12. The tool in accordance with claim 11 in which said tension sensing means includes an abutment member adjacent said tension arm and switch means on said tension arm responsive to movement of said tension arm against said abutment means for actuating said control means whereby, when said loop is tensioned to said predetermined level of tension, the force in said second overlapping strap segment acting on said tension foot causes said overlapping strap segments to compress so that said tension arm pivots further and carries said switch against said abutment member to actuate said switch whereby the motor rotation is reversed from said first direction to said second direction.

13. The tool in accordance with claim 12 in which the location of said abutment member relative to said tension arm is adjustable.

14. The tool in accordance with claim 11 further including operating lever means pivotably mounted to said frame, said operating lever means having a camming surface, said tension arm further having a cam adapted to contact said operating lever camming surface whereby movement of said operating lever pivots said tension arm to move said tensioning foot away from said tension wheel for permitting insertion of said overlapping strap segments between said tension wheel and said tension foot.

15. The tool in accordance with claim 5 further including a base carried by said frame, a plate disposed below said pressing means and adapted to contact said second overlapping strap segment, and a resilient member disposed beneath said plate between said base and said plate to permit rocking movement of said plate when said first and second overlapping strap segments are pressed together by said pressing means and when said pressing means is oscillated by said oscillating drive means.

16. The tool in accordance with claim 5 further including means for severing the trailing portion of said strap loop before said strap loop has been sealed, said severing means including a saw blade pivotably mounted from said frame and having upwardly projecting saw teeth, said saw blade adapted to lie between said first and second overlapping strap segments whereby, when said first overlapping strap segment is pressed against said second overlapping strap segment by said pressing means and when said pressing means is oscillated by said oscillating drive means, said first overlapping strap segment is moved generally transversely of the strap length relative to said second overlapping strap segment and against said saw blade causing said saw blade to cut through said first overlapping strap segment before said strap segments are welded and to thereby sever the trailing portion of the strap loop from the strap loop.

17. The tool in accordance with claim 16 in which said pressing means includes slotted guide means and in which said saw blade is received within said slotted guide means.

18. An all-electrically operated tool for tensioning and sealing a loop of thermoplastic strap that encircles an article and has first and second overlapping strap segments, said tool comprising:

a frame;

a first shaft mounted for rotation about its longitudinal axis relative to said frame, said first shaft defining a receiving bore having a longitudinal axis concentric with the longitudinal axis of rotation of said first shaft;

an electrically operated, reversible motor carried by said frame for rotating said first shaft sequentially in a first direction and then in a second, opposite direction;

a second shaft having one end received in said first shaft receiving bore and mounted for rotation about its longitudinal axis relative to said frame;

a tension means mounted to said frame for initially gripping said first overlapping segment of the strap and moving said strap to tension said loop;

transmission means drivably connecting said second shaft with said tension means;

at least one one-way clutch means within said first shaft receiving bore for engaging said first and second shafts to permit rotation of said second shaft with said first shaft in said first direction to tension said strap loop and to permit said first shaft to rotate in a second, opposite direction without effecting a rotation of said second shaft in said second direction;

means for sensing a predetermined level of tension in said strap loop;

control means responsive to said loop tension sensing means for reversing the rotation of said motor from said first direction of rotation to said second direction of rotation when said predetermined loop tension level is sensed by said tension sensing means;

means responsive to the rotation of said first shaft in said second direction for pressing said first and second overlapping strap segments together after said strap loop has been tensioned to said predetermined level; and oscillating drive means on said first shaft for oscillating said strap pressing means to move said first overlapping strap segment generally transversely of the strap length relative to the second overlapping strap segment to effect a friction fusion weld of said overlapping segments.

19. The tool in accordance with claim 18 in which said pressing means further includes:

a pressing member adapted to be oscillated by said oscillating means;

a rocker arm pivotably mounted on said frame and having first and second end portions;

link means pivotably connected at one end to said rocker arm second end portion and pivotably connected at the other end to said pressing member;

rocker arm spring means for urging said rocker arm to pivot relative to said frame to force said pressing member against said first overlapping strap segment;

a release pawl pivotably mounted on said frame and having a latch means for engaging said rocker arm first end portion;

a release pawl spring means for urging said release pawl against said rocker arm first end portion to engage said latch means;

a release ring mounted about said first shaft and adapted to engage said release pawl; and second clutch means drivably connecting said first shaft with said release ring member for rotating said release ring with said first shaft in said second direction to move said release pawl latch means out of engagement with said rocker arm first end portion and adapted to disengage said release ring from said first shaft when said first shaft is rotated in said first direction whereby, when said first shaft is rotated in said second direction, said second clutch means is engaged and said release ring rotates in said second direction to force said release pawl to pivot away from said rocker arm first end portion and release said rocker arm first end portion from said release pawl latch means so that said rocker arm is urged by said rocker arm spring means to force said pressing member against said first overlapping strap segment.

20. The tool in accordance with claim 19 in which said release ring defines a peripheral groove and at least one wall portion at an end of said groove for engaging said release pawl.

21. The tool in accordance with claim 20 in which:

said release pawl defines a bore and has a plunger slidably mounted within said bore;

said release pawl further includes a compression spring disposed within said bore and adapted for urging said plunger into said groove in said release ring;

said release pawl has a cam surface adapted to be engaged by said rocker arm first end portion when said first end portion is disengaged from said latch means whereby said release pawl is held with said plunger away from said release ring wall portion;

said tool further includes reset link means secured to said rocker arm for being forced in one direction to pivot said rocker arm against the urging of said rocker arm spring to bring said rocker arm first end portion into engagement with said latch means whereby, when said release ring is rotated in said second direction, said release ring wall portion forces said plunger, and hence said release pawl, away from said release ring thereby pivoting said release pawl to disengage said latch means from said rocker arm first end portion so that said rocker arm is urged by said rocker arm spring to move said link means to urge said pressing means into contact with said first overlapping strap segment and whereby, when said reset link means is forced to relatch said rocker arm with said release pawl, said compression spring permits said plunger to be moved further into said bore if said release ring should contact said plunger.

22. The tool in accordance with claim 18 in which said tension means includes (a) a tension wheel adapted to grip said strap, (b) a tension arm pivotably mounted to said frame, said tension arm having a tension foot adjacent said tension wheel, and (c) a tension arm spring means urging said tension arm to pivot relative to said frame to urge said tension foot towards said tension wheel to thereby press said first and second overlapping strap segments between said tension wheel and said tension foot and in which said tension sensing means includes (a) an abutment member adjacent said tension arm, (b) switch means on said tension arm responsive to movement of said tension arm against said abutment means for actuating said control means; and (c) a spring plate cantilevered over said switch means to absorb impact energy when said tension arm is suddenly moved against said switch means by said abutment means, such as if said strap were to accidently fail.

23. The tool in accordance with claim 18 in which said oscillating drive means includes an eccentric portion on said first shaft having a generally cylindrical exterior drive surface oriented about a longitudinal axis parallel to, but displaced from, said first shaft longitudinal axis; in which said oscillating means further includes a driven ring member mounted about said eccentric portion for revolution about said first shaft longitudinal axis with said eccentric portion during rotation of said first shaft in either of said first and second directions of rotation, said driven ring member having a generally cylindrical inner driven surface disposed on said generally cylindrical exterior drive surface of said eccentric portion to permit rotation of said eccentric portion within and relative to said ring member; and in which said pressing means includes a pressing member mounted to said driven ring member for contacting said first overlapping strap segment whereby rotation of said first shaft oscillates said pressing member.

24. The tool in accordance with claim 18 further including a balance weight secured to said first shaft to counterbalance the weight of said eccentric portion.

25. A tool for constricting and closing a loop of thermoplastic strap that encircles an article and has overlapping strap segments, said tool comprising:

means for constricting said loop;

reversible motor means for rotating initially in a first direction and then in a second, opposite direction;

drive shaft means driven by said reversible motor means sequentially in said first and second directions of rotation for engaging and operating said constricting means to constrict said strap loop only when said drive shaft means is rotated in said first direction;

sensing and control means for sensing a predetermined level of tension in the constricted strap loop and for reversing the rotation of said motor means to change rotation of said drive shaft means from said first direction of rotation to said second direction of rotation;

means responsive to rotation of said drive shaft means in said second direction for pressing said overlapping strap segments together after said strap loop has been constricted to said predetermined tension level; and oscillating drive means on said drive shaft means for oscillating said strap pressing means to move at least one of said overlapping strap segments generally transversely of the strap length relative to the other strap segment to effect a driction fusion weld of said overlapping segment.

26. The tool in accordance with claim 25 further including means for severing the trailing portion of said strap loop before said strap loop has been friction fusion welded, said severing means including a saw blade having upwardly projecting saw teeth, said saw blade adapted to lie between said overlapping strap segments whereby, when at least one of said overlapping strap segments is pressed against the other of said overlapping strap segments by said pressing means and when said pressing means is oscillated by said oscillating drive means, one of said overlapping strap segments is moved generally transversely of the strap length relative to the other overlapping strap segment and against said saw blade causing said saw blade to cut through one of said overlapping strap segments before the strap segments are friction fusion welded and to thereby sever the trailing portion of the strap from the strap loop.

27. The tool in accordance with claim 25 in which said pressing means includes (a) a pressing member mounted for movement between a first position out of contact with said overlapping strap segments and a second position in contact with and pressing against said overlapping strap segments, (b) biasing means for urging said pressing member from said first position to said second position, (c) latch means restraining said biasing means to hold said pressing member in said second position, (d) release means adapted to unlatch said latch means to permit said biasing means to move said pressing member to said second position, and (e) clutch means drivably connecting said drive shaft means with said release means for rotating said release means with said drive shaft means in said second direction to unlatch said latch means to allow said biasing means to urge said pressing member against said overlapping strap segments in said second position, said clutch means adapted to disengage said release means from said drive shaft means when said drive shaft means is rotated in said first direction.

28. The tool in accordance with claim 25 in which said oscillating driving means includes (a) an eccentric portion on said drive shaft means having a generally cylindrical exterior drive surface oriented about a longitudinal axis parallel to, but displaced from, the longitudinal axis of said drive shaft means and (b) a driven ring member mounted on said eccentric portion of said drive shaft means and having a generally cylindrical inner drive surface disposed on said generally cylindrical exterior drive surface of said eccentric portion to permit movement of said ring member with said eccentric portion while allowing rotation of said eccentric portion relative to said ring member; and in which said pressing means includes a pressing member mounted to said driven ring member for contacting one of said overlapping strap segments whereby rotation of said drive shaft means oscillates said pressing member to oscillate said one strap segment.

29. In a tool for constricting and closing a loop of thermoplastic strap that encircles an article and has overlapping strap segments and that has a frame on which is mounted means for constricting said loop; sensing and control means for sensing a predetermined level of tension in the constricted strap loop; and means responsive to said sensing and control means for pressing the overlapping strap segments together after the loop has been constricted to said predetermined tension level and for moving at least one of said overlapping strap segments generally transversely of the strap length relative to the other strap segment to effect a friction fusion weld of said overlapping segments; the improvement comprising:

a saw blade having projecting saw teeth, said saw blade being pivotably mounted on said frame and being restrained against reciprocating movement, said saw blade being adapted to be pivoted between a lowered position for contacting a surface of said one overlapping strap segment and an elevated position in which the strap may be disposed in, or removed from the tool whereby, when said pressing means is moving said one overlapping strap segment relative to said other overlapping strap segment to effect a friction fusion weld of the overlapping segments, said one overlapping strap segment is moved across the teeth of said saw blade so that said saw blade cuts through said one overlapping strap segment before the welding of the straps is completed and thereby at least substantially severs the trailing portion of the strap loop from the tensioned strap loop encircling the article.

30. The improvement in accordance with claim 29 in which said saw blade has upwardly projecting saw teeth and is adapted to lie between said overlapping strap segments whereby, when said one overlapping strap segment is pressed against the other overlapping strap segment by said pressing means and moved by said pressing means, said one overlapping strap segment is moved generally transversely of the strap length relative to said other overlapping strap segment and downwardly against said saw blade causing said saw blade to cut through said one overlapping strap segment.

31. The improvement in accordance with claim 30 in which said pressing means includes slotted guide means and in which said saw blade is received within said slotted guide means.

32. In a tool for constricting and closing a loop of thermoplastic strap that encircles an article and has overlapping strap segments, said tool comprising:

a frame;

means for constricting said loop;

sensing and control means for sensing a predetermined level of tension in the constricted strap loop;

means responsive to said sensing and control means for pressing the overlapping strap segments together after the loop has been constricted to said predetermined tension level and for moving at least one of said overlapping strap segment generally transversely of the strap length relative to the other strap segment to effect a friction fusion weld of said overlapping segments;

a saw blade pivotally mounted on said frame and having downwardly projecting saw teeth, said saw blade being restrained against reciprocating movement and being adapted to be pivoted between a lowered position contacting an upper surface of said one overlapping strap segment and an elevated position spaced from the upper surface of said one overlapping strap segment, said saw blade including means for being engaged by said pressing means and being moved to said elevated position from said lowered position; and means for biasing said saw blade against the upper surface of said one overlapping strap segment when said pressing means is moving said one overlapping strap segment relative to said other overlapping strap segment to effect a friction fusion weld of the overlapping segments thereby causing said saw blade to cut through said one overlapping strap segment before the welding of the straps is completed and to thus at least substantially sever the trailing portion of the strap loop from the tensioned strap loop encircling the article.

33. The tool in accordance with claim 32 in which said biasing means is a helical compression spring disposed between a portion of the tool frame and a portion of said saw blade.

34. The tool in accordance with claim 1 in which said tool includes a frame; in which said strap segment pressing and moving means includes means for moving said one overlapping strap segment generally transversely of the strap length relative to the other strap segment to effect a friction fusion weld of said overlapping segments; in which said tool has a saw blade pivotally mounted on said frame and having downwardly projecting saw teeth, said saw blade being restrained against reciprocating movement and being adapted to be pivoted between a lowered position contacting an upper surface of said one overlapping strap segment and an elevated position spaced from the upper surface of said one overlapping strap segment, said saw blade including means for being engaged by said pressing means and being moved to said elevated position from said lowered position; and in which said tool includes means for biasing said saw blade against the upper surface of said one overlapping strap segment when said pressing means is moving said one overlapping strap segment relative to said other overlapping strap segment to effect a friction fusion weld of the overlapping segments thereby causing said saw blade to cut through said one overlapping strap segment before the welding of the straps is completed and to thus at least substantially sever the trailing portion of the strap loop from the tensioned strap loop encircling the article.

35. The tool in accordance with claim 34 in which said biasing means is a helical compression spring disposed between a portion of the tool frame and a portion of said saw blade.

* * * * *

UNITED STATES PATENT AND TRADEMARK OFFICE

CERTIFICATE OF CORRECTION

PATENT NO. : 4,313,779

DATED : February 2, 1982

INVENTOR(S) : Robert J. Nix

It is certified that error appears in the above—identified patent and that said Letters Patent is hereby corrected as shown below:

Column 7, line 9, "for" should be --or--.

Column 8, line 11, "about the p." should be --about the package p.--.

Column 8, line 58, "mouinted" should be --mounted--.

Column 9, line 29, "th" should be --the--.

Column 26, line 13, "driction" should be --friction--.

Column 9, line 20, "183" should be --186--.

Column 9, line 64, "drive" should be --driven--.

Signed and Sealed this

First Day of June 1982

[SEAL]

Attest:

GERALD J. MOSSINGHOFF

Attesting Officer

Commissioner of Patents and Trademarks